US006570544B2

(12) United States Patent
Yordy, Sr.

(10) Patent No.: US 6,570,544 B2
(45) Date of Patent: May 27, 2003

(54) RADIATOR COMPONENTS THAT SERVE TO TRANSMIT INFORMATION OVER FREQUENCIES IN RANGE WITH ONE OR MORE OCTAVES LESS THAN OR EQUAL TO THIRTY MEGAHERTZ AND THAT COMPRISE MAJOR DIMENSION LESS THAN OR EQUAL TO NINE METERS

(75) Inventor: William Richard Yordy, Sr., Gulfport, MS (US)

(73) Assignee: Litton Systems, Inc., Woodlands Hills, CA (US)

( * ) Notice: Subject to any disclaimer, the term of this patent is extended or adjusted under 35 U.S.C. 154(b) by 59 days.

(21) Appl. No.: 09/850,925

(22) Filed: May 8, 2001

(65) Prior Publication Data

US 2002/0167455 A1 Nov. 14, 2002

(51) Int. Cl.[7] ..... H01Q 21/00
(52) U.S. Cl. ..... 343/844; 343/893; 343/900
(58) Field of Search ..... 343/711–715, 900, 343/874, 875, 890, 891, 787, 844, 846, 893

(56) References Cited

U.S. PATENT DOCUMENTS

| | | | | |
|---|---|---|---|---|
| 3,864,686 A | * | 2/1975 | Owen | 343/713 |
| 3,931,625 A | | 1/1976 | Chiron et al. | 343/787 |
| 3,950,756 A | * | 4/1976 | Tisler | 343/766 |
| 4,099,184 A | * | 7/1978 | Rapshys | 343/875 |
| 4,125,840 A | | 11/1978 | Cassel | 343/807 |
| 4,186,401 A | * | 1/1980 | Altmayer | 343/715 |
| 4,209,790 A | * | 6/1980 | Newcomb | 343/830 |
| 5,417,597 A | | 5/1995 | Levedahl | 440/6 |

FOREIGN PATENT DOCUMENTS

EP 0492022 7/1992

OTHER PUBLICATIONS

"reactance," http://www.dictionary.com/cgi–bin/dict.pl-?term=reactance; American Heritage Dictionary of the English Language, 3rd Edition, Houghton Mifflin Company, Lexico, LLC, Los Angeles, CA; Mar. 16, 2001.

"reactance," http://www.dictionary.com/cgi–bin/dict.pl-?term=reactance; Webster's Revised Unabridged Dictionary MICRA, Inc.; Lexico, LLC, Los Angeles, CA; Mar. 16, 2001.

(List continued on next page.)

*Primary Examiner*—Hoang Nguyen

(57) ABSTRACT

A first radiator component and a second radiator component of a system serve to transmit information over a plurality of frequencies in a range that comprises one or more octaves less than or equal to thirty megahertz. The first radiator component comprises a major dimension that is less than or equal to nine meters. The second radiator component comprises a major dimension that is less than or equal to nine meters.

38 Claims, 23 Drawing Sheets

OTHER PUBLICATIONS

"reactance," http://www.dictionary.com/cgi–bin/dict.pl-?term=reactance; WordNet, Princeton University; Lexico, LLC, Los Angeles, CA; Mar. 16, 2001.

"broadband," http://www.its.bldrdoc.gov/projects/telecom-glossary2000/__broadband.html; Institute for Telecommunication Services; 325 Broadway, Boulder, Co., 80305–3328; Mar. 14, 2001.

"narrowband signal" http://www.its.bldrdoc.gov/projects/telecomglossary2000/__narrowband__signal.html; Institute for Telecommunication Services; 325 Broadway, Boulder, Co., 80305–3328; Mar. 14, 2001.

"broadband," http://www.techweb.com/encyclopedia/defineterm?term=broadband; CMP Media, Inc., Manhasset, N.Y., Mar. 13, 2001.

"narrowband," http://www.techweb.com/encyclopedia/defineterm?term=narrow+band; CMP Media, Inc., Manhasset, N.Y., Mar. 13, 2001.

"azimuth," http://www.techweb.com/encyclopedia/defineterm?term=azimuth; CMP Media, Inc., Manhasset, N.Y., Mar. 13, 2001.

"voltage standing wave ratio (VSWR)," http://www.its-.bldrdoc.gov/fs–1037/dir–039/__5838.htm; Institute for Telecommunication Services; 325 Broadway, Boulder, Co., 80305–3328; Mar. 14, 2001.

"Voltage Standing Wave Ratio (VSWR)/Reflection Coefficient Return Loss/Mismatch Loss," http://ewhdbks.mugu.navy.mil/VSWR.htm; Electronic Warfare and Radar Systems Engineering Handbook; Naval Air Warfare Center Weapons Division, Point Mugu, CA 93042; Mar. 14, 2001.

* cited by examiner

100
SOURCE
158
106
506
150
156
146
152
148
154
404
144
118
142
112
114
126
104
116
130
124
178
122
176
136
140
134
312
113
102
108
160
128
120
174
103
105
107
110
138
132
109
111

100
204
207
209
208
206
206
0
2
3
4
6
8
9
10
12
12.5
14
15
18
20
24
25
28
30
FREQUENCY [MHz]
202
103

100
[Ohms]
REACTANCE
[Ohms]
RESISTANCE
Z-in = R + jX.
R= 0.3366
X= -0.2565
T [a]= 576.0000
C [b]= 78000.0000
L [c]= 331.0000
L [d]= 12.0000
W [e]= -----
T F 2.0000 MHz
INDUCTIVE
REACTANCE [Ohms]
CAPACITIVE
REACTANCE [Ohms]
GAMMA MAGNITUDE = 0.5226
GAMMA ANGLE (deg) = -147.9987
RETURN LOSS (dB.) = 5.6374
VSWR = 3.1890
Z0 = 1.0000
x=0.5
x=0
x=-0.5
x=1
x=-1
r=0
r=0.5
r=1
r=2
502
504
506
508
510
512
514
516
518
520
522
524
526
528
530
532
534
202

100

100

Z-in = R + jX.
R= 0.4429
X= 0.2537

T a= 576.0000
C b= 78000.0000
L c= 331.0000
L d= 12.0000
W e= -----
T F 4.0000 MHz

202

GAMMA MAGNITUDE = 0.4179
GAMMA ANGLE (deg) = 145.5425
RETURN LOSS (dB.) = 7.5789
VSWR = 2.4357

100

100

100

100

100

100

Z-in = R + jX.
R= 0.3952
X= −0.5232

100

100

100

100

100

100

100

100

RADIATOR COMPONENTS THAT SERVE TO TRANSMIT INFORMATION OVER FREQUENCIES IN RANGE WITH ONE OR MORE OCTAVES LESS THAN OR EQUAL TO THIRTY MEGAHERTZ AND THAT COMPRISE MAJOR DIMENSION LESS THAN OR EQUAL TO NINE METERS

TECHNICAL FIELD

The invention in one embodiment relates generally to communications and more particularly to employment of radiator components in an antenna system.

BACKGROUND

In one example, it is desirable to reduce the radar cross section ("RCS") of a body (e.g., "a platform"). Such a body in one example comprises a vessel, for example, an air-based, land-based, or water-based vehicle, for instance, a ship such as a surface combatant of a navy. Reduction of the radar cross section in one example serves to reduce the "electronic visibility" of the body.

One exemplary approach for attempting to reduce radar cross section employs materials with decreased reflectivity, for example, substantially non-reflective materials. With the use of such decreased-reflection materials, however, a challenge exists in location and concealment of one or more antennas for exterior communication systems, for example, onboard a vessel.

The physical size of each antenna in one example creates difficulties upon an attempt to place antennas within or behind the decreased-reflection material. In another example, an attempt to place antennas within or behind the decreased-reflection material causes (e.g., severe) disturbances in electrical characteristics of the antennas.

In addition, a surface combatant in one example employs a relatively large number of relatively high frequency ("HF") circuits during day-to-day activities. To conserve space and decrease mutual interference between circuits, one exemplary approach combines several relatively high frequency transmitters into a single broadband antenna. One exemplary design also employs in the antenna several relatively large radiators, each covering a portion of a selected or required range. An exemplary implementation of the antenna matches the radiators to the transmitters with a passive lumped constant network. A further exemplary implementation matches the radiators to the transmitters with a passive lumped constant network plus resistive networks, for example, to accomplish broadbanding of the antenna.

As one exemplary shortcoming, such a design provides an undesirable lack of matching between the radiators and the transmitters, for example, over a selected or required range, for instance, upon location of the radiators near material with decreased reflectivity. Location of the radiators proximately relative to material with decreased reflectivity in one example serves to undesirably alter electrical characteristics of the radiator.

Thus, a need exists for enhanced radiators that are employable to transmit information under particular (e.g., physical) constraints.

SUMMARY

Pursuant to one embodiment of the invention, shortcomings of the existing art are overcome and additional advantages are provided through the provision of radiator components that serve to transmit information over frequencies in a range with one or more octaves less than or equal to thirty megahertz and that comprise a major dimension less than or equal to nine meters.

The invention in one embodiment encompasses a system. A first radiator component and a second radiator component of the system serve to transmit information over a plurality of frequencies in a range that comprises one or more octaves less than or equal to thirty megahertz. The first radiator component comprises a major dimension that is less than or equal to nine meters. The second radiator component comprises a major dimension that is less than or equal to nine meters.

Another embodiment of the invention encompasses a method. A first radiator component and a second radiator component are selected that serve to transmit information over a plurality of frequencies in a range that comprises one or more octaves less than or equal to thirty megahertz. The first radiator component is selected to comprise a major dimension that is less than or equal to nine meters. The second radiator component is selected to comprise a major dimension that is less than or equal to nine meters.

These and other features and advantages of one embodiment of the invention will become apparent from the description, the accompanying drawings, and the claims.

DETAILED DESCRIPTION

In one embodiment of the invention, radiator components serve to transmit information over frequencies in a range with one or more octaves less than or equal to thirty megahertz, and the radiator components comprise a major dimension less than or equal to nine meters. A detailed discussion of one exemplary embodiment of the invention is presented herein, for illustrative purposes.

Figure 1:
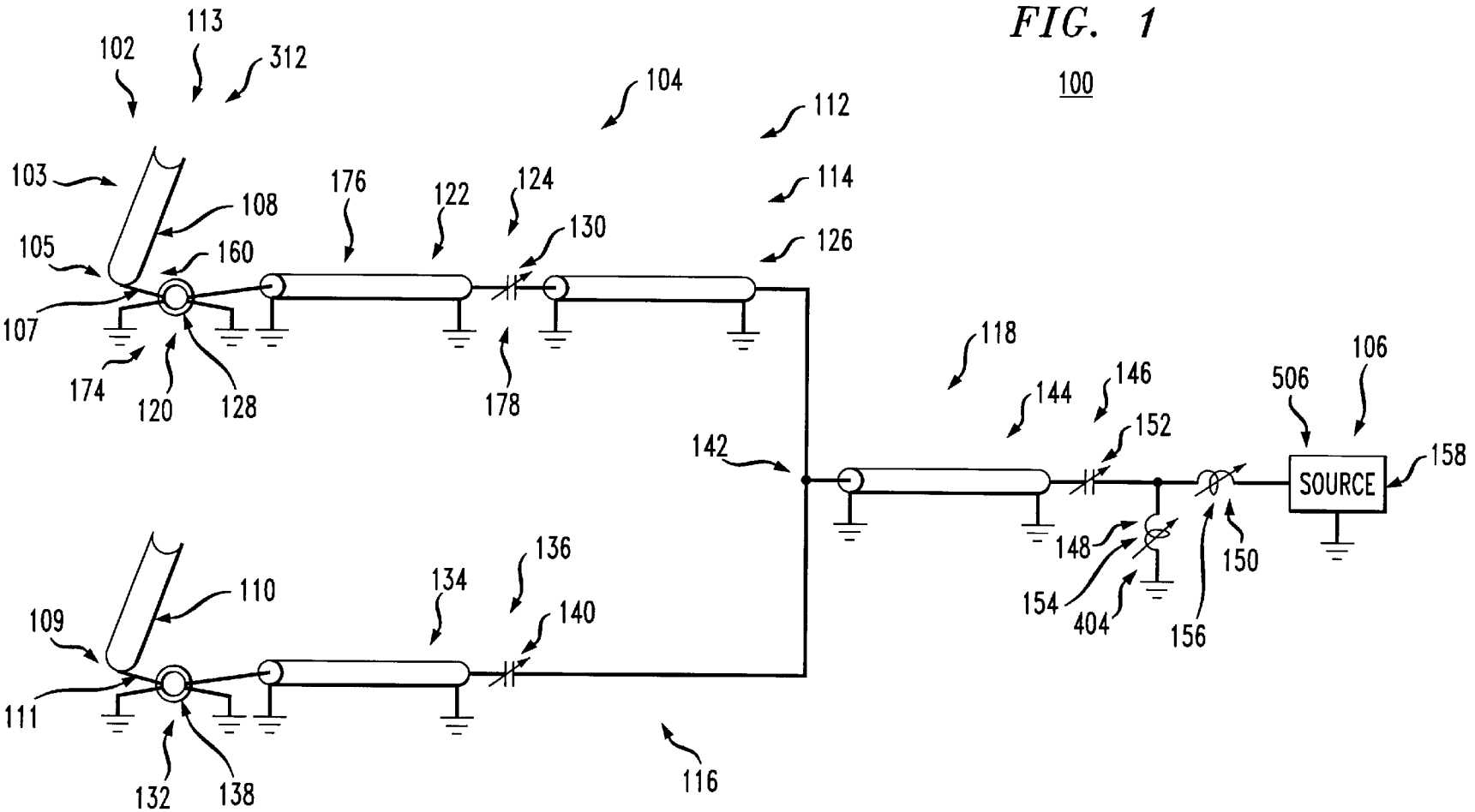
FIG. 1 is a representation of one example of a system that includes one or more instances of a radiator component, one or more instances of a network, and one or more instances of a transmitter component.

Turning to FIG. 1, system 100, in one example, includes a plurality of components such as hardware components. A number of such components can be combined or divided in one example of system 100. In one example, system 100 comprises an antenna system.

Referring again to FIG. 1, system 100 in one example comprises one or more components, for example, one or more instances of radiator component 102, one or more instances of network 104, and one or more instances of transmitter component 106.

Figure 4:
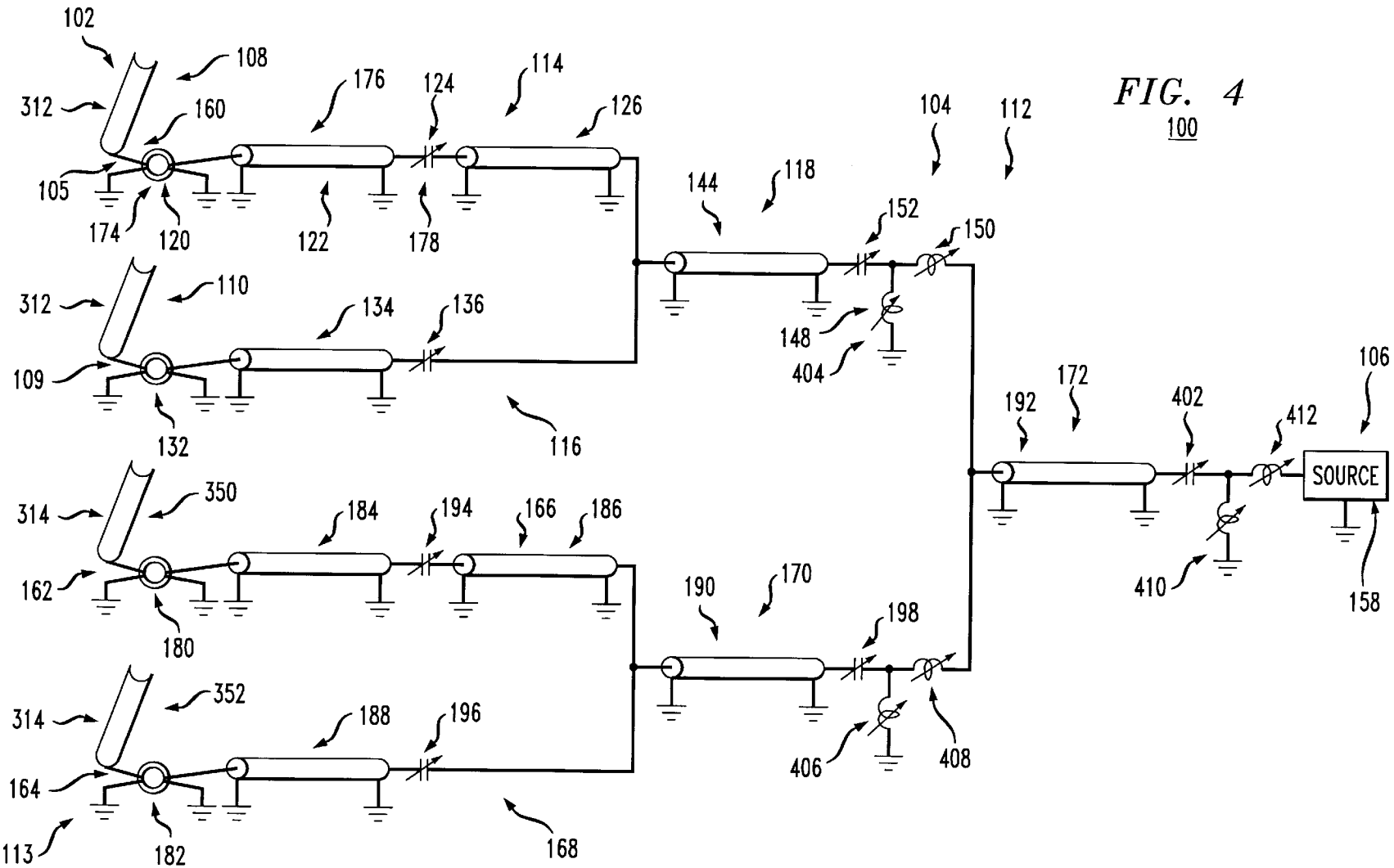
FIG. 4 is a representation of yet another example of the system of FIG. 1 that includes one or more instances of the radiator component, one or more instances of the network, and one or more instances of the transmitter component.
Figure 5:
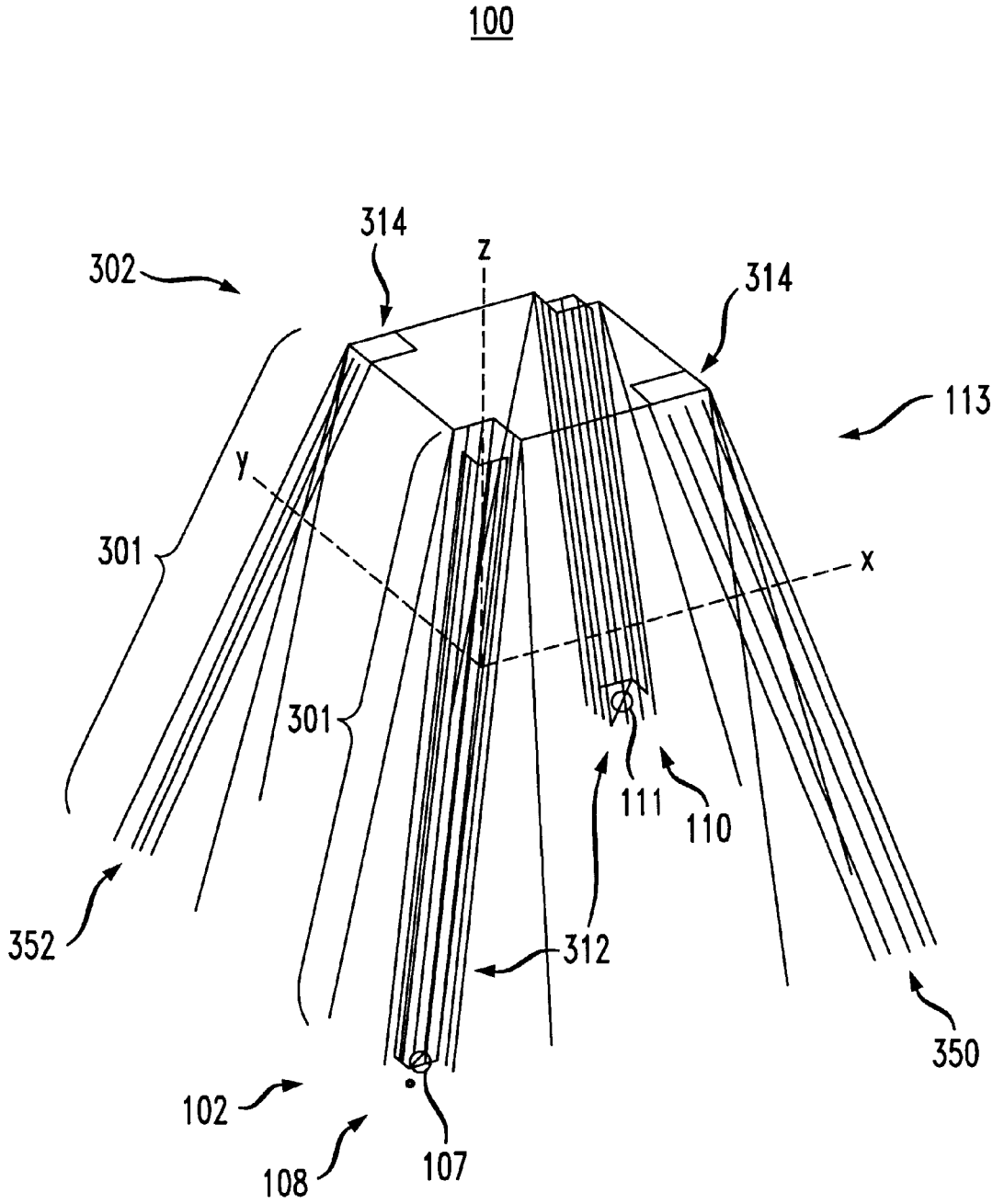
FIG. 5 represents illustrative details of one example of a plurality of sets of instances of the radiator component in a structural component of the system of FIG. 1.
Figure 6:
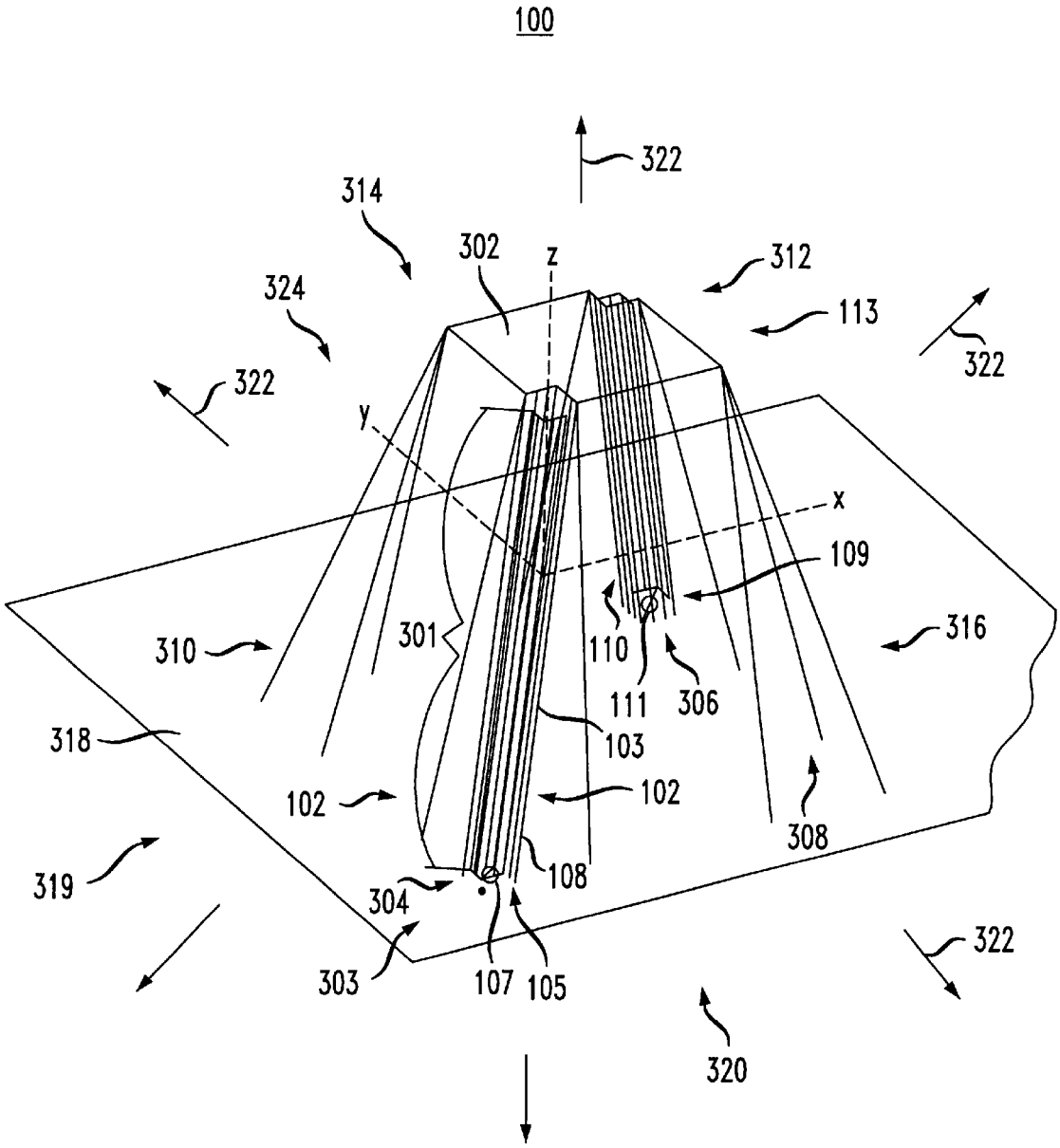
FIG. 6 represents illustrative details of one example of a plurality of instances of the radiator component in a structural component on a body of the system of FIG. 1.

Still referring to FIG. 1, radiator component 102 in one example comprises major dimension 301 (FIGS. 5 and 6). Major dimension 301 in one example comprises any selected and/or approximate size. For example, major dimension 301 is less than or equal to nine meters. In another example, major dimension 301 is greater than or equal to two meters and less than or equal to six meters. For instance, major dimension 301 comprises five meters. One or more instances of radiator component 102 in one example may have a substantially equal value for major dimension 301. In another example, one or more instances of radiator component 102 may have different values for major dimension 301. Exemplary instances of radiator component 102 comprise radiator components 108, 110, 350 (FIGS. 3–5), and 352 (FIGS. 3–5).

Again referring to FIG. 1, radiator component 108 in one example is coupled with network 104, for example, through an instance of interface 160. Exemplary instances of interface 160 comprise interfaces 105, 109, 162 (FIGS. 3 and 4), and 164 (FIGS. 3 and 4). For example, radiator component 108 is coupled with network 104 through interface 105. Interface 105 in one example comprises feedpoint 107. Radiator component 110 in one example is coupled with network 104, for example, through interface 109. Interface 109 in one example comprises feedpoint 111. One or more instances of network 104 in one example serve to couple one or more of radiator components 108, 110, 350, and 352 with an instance of transmitter component 106.

Figure 3:
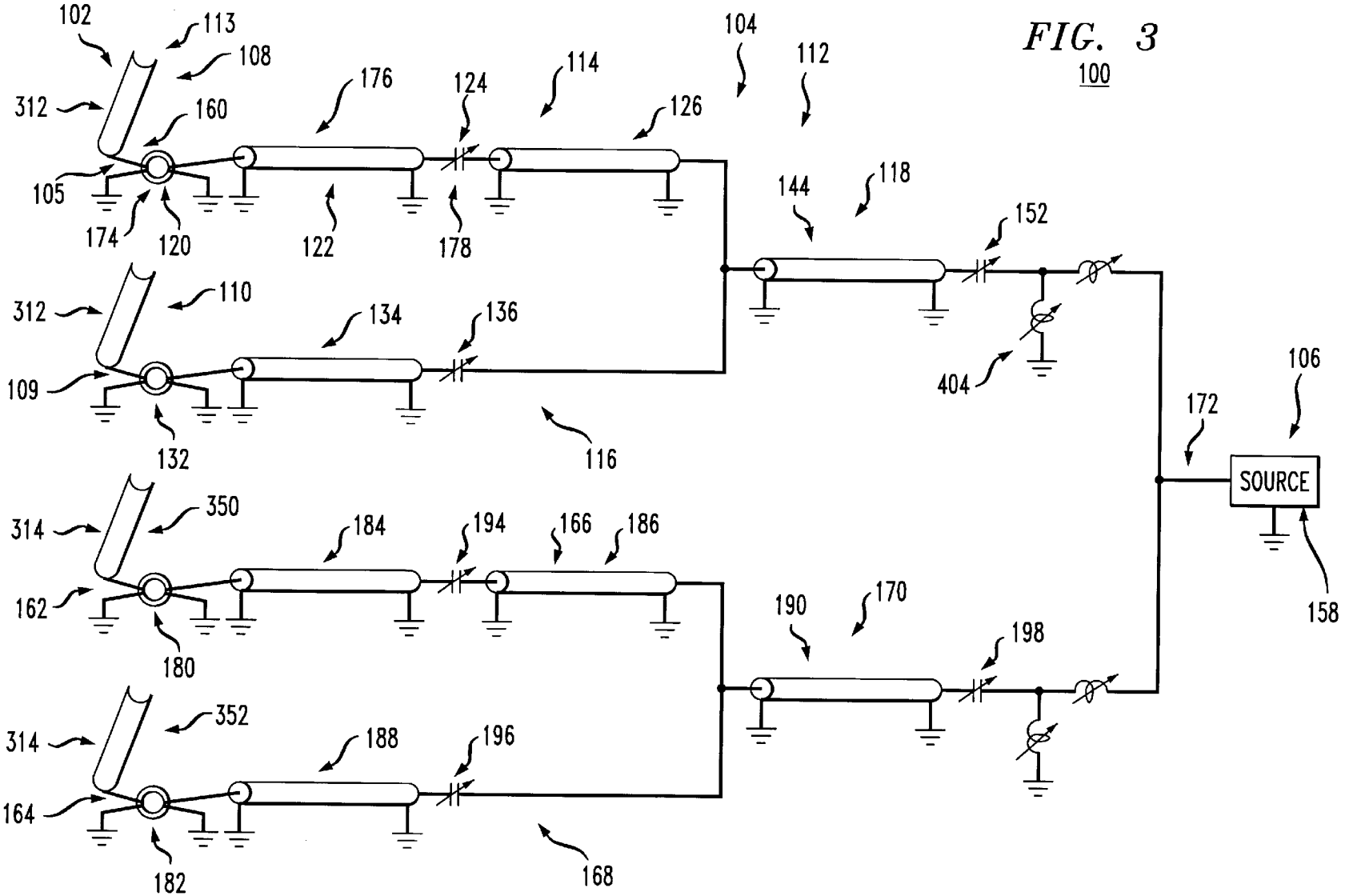
FIG. 3 is a representation of another example of the system of FIG. 1 that includes one or more instances of the radiator component, one or more instances of the network, and one or more instances of the transmitter component.

Referring further to FIGS. 1 and 3–4, network 104 in one example comprises one or more instances of portion 112. Exemplary instances of portion 112 comprise portions 114, 116, 118, 166, 168, 170, and 172. Portions 114 and 116 in one example are electrically in parallel. In a further example, portions 114 and 116 result in effective result 142. Effective result 142 in one example is electrically in series with portion 118, as will be appreciated by those skilled in the art. Portion 114 in one example comprises interface 105, an instance of transformer 174, an instance of transmission line 176, and an instance of capacitor 178.

Referring to FIGS. 1 and 3–4, transformer 174 in one example comprises any selected transformer. Exemplary instances of transformer 174 comprise transformers 120, 132, 180, and 182.

Again referring to FIGS. 1 and 3–4, transmission line 176 in one example comprises any selected length and/or impedance. Exemplary instances of transmission line 176 comprise transmission lines 122, 126, 134, 144, 184, 186, 188, 190, and 192.

Referring still to FIGS. 1 and 3–4, in one example, capacitor 178 comprises a variable capacitor. In another example, capacitor 178 comprises a non-variable capacitor. In a further example, capacitor 178 comprises any selected capacitance. Exemplary instances of capacitor 178 comprise capacitors 124, 136, 152, 194, 196, 198, and 402.

For example, referring to FIG. 1, portion 114 comprises interface 105, transformer 120, transmission line 122, capacitor 124, and transmission line 126. Transformer 120 in one example comprises broadband radio frequency ("RF") transformer 128. Broadband radio frequency transformer 128 in one example comprises any selected ratio. For example, broadband radio frequency transformer 128 comprises a 49/1 broadband radio frequency transformer. In one example, transformer 120 serves to couple radiator component 108 with transmission line 122.

Referring still to FIG. 1, transmission line 122 in one example comprises any selected length and/or impedance. In one example, transmission line 122 comprises a length of 11.43 meters (37.5 feet) and an impedance of 37.5 Ohms ("Ω"). Capacitor 124 in one example serves to couple transmission line 122 with transmission line 126. In one example, capacitor 124 comprises variable capacitor 130. In another example, capacitor 124 comprises a non-variable capacitor. In a further example, capacitor 124 comprises any selected capacitance. For example, capacitor 124 comprises a capacitance of 2000 picofarads ("pF").

Again referring to FIG. 1, transmission line 126 in one example comprises any selected length and/or impedance. In one example, transmission line 126 comprises a length of 12.50 meters (41 feet) and an impedance of 50 Ohms. Transmission line 126 in one example serves to couple portion 114 with portions 116 and 118.

Referring further to FIG. 1, portion 116 in one example comprises interface 109, transformer 132, transmission line 134, and capacitor 136. Transformer 132 in one example comprises any selected transformer. For example, transformer 132 comprises broadband radio frequency transformer 138. Broadband radio frequency transformer 138 in one example comprises any selected ratio. For example, broadband radio frequency transformer 138 comprises a 49/1 broadband radio frequency transformer. In one example, transformer 132 serves to couple radiator component 110 with transmission line 134.

Still referring to FIG. 1, transmission line 134 in one example comprises any selected length and/or impedance. In one example, transmission line 134 comprises a length of 23.93 meters (78.5 feet) and an impedance of 37.5 Ohms. Transmission line 134 in one example is coupled with capacitor 136.

Referring further to FIG. 1, capacitor 136 in one example comprises variable capacitor 140. In another example, capacitor 136 comprises a non-variable capacitor. In a further example, capacitor 136 comprises any selected capacitance. For example, capacitor 136 comprises a capacitance of 2000 picofarads. For example, capacitor 136 serves to couple portion 116 with portions 114 and 118.

Referring again to FIG. 1, portion 118 in one example comprises transmission line 144, capacitor 146, and a number of instances of inductor 404. Inductor 404 in one example comprises a variable inductor. In another example, inductor 404 comprises a non-variable inductor. In a further example, inductor 404 comprises any selected inductance. Referring to FIGS. 1 and 3–4, exemplary instances of inductor 404 comprise inductors 148, 150, 406, 408, 410, and 412.

For example, referring to FIG. 1, portion 118 comprises transmission line 144, capacitor 146, and inductors 148 and 150. Transmission line 144 in one example serves to couple portion 118 with portions 114 and 116. In one example, transmission line 144 comprises any selected length and/or impedance. For example, transmission line 144 comprises a length of 14.63 meters (48 feet) and an impedance of 37.5 Ohms. In a further example, transmission line 144 is coupled with capacitor 146.

Still referring to FIG. 1, capacitor 146 in one example comprises variable capacitor 152. In another example, capacitor 146 comprises a non-variable capacitor. In a further example, capacitor 146 comprises any selected capacitance. For example, capacitor 146 comprises a capacitance of 1560 picofarads. In a still further example, capacitor 146 serves to couple transmission line 144 with inductors 148 and 150.

Referring further to FIG. 1, inductor 148 in one example comprises variable inductor 154. In another example, inductor 148 comprises a non-variable inductor. In a further example, inductor 148 comprises any selected inductance. For example, inductor 148 comprises an inductance of 16.55 microhenry ("$\mu$H").

Again referring to FIG. 1, inductor 150 in one example comprises variable inductor 156. In yet another example, inductor 150 comprises a non-variable inductor. In a still further example, inductor 150 comprises any selected inductance. For example, inductor 150 comprises an inductance of 0.6 microhenry. Inductor 150 in one example serves to couple portion 118 with transmitter component 106.

Referring still to FIG. 1, transmitter component 106 in one example comprises source 158. Source 158 in one example comprises any selected transmitter source. For example, source 158 comprises a 50 Ohm source.

Figure 2:
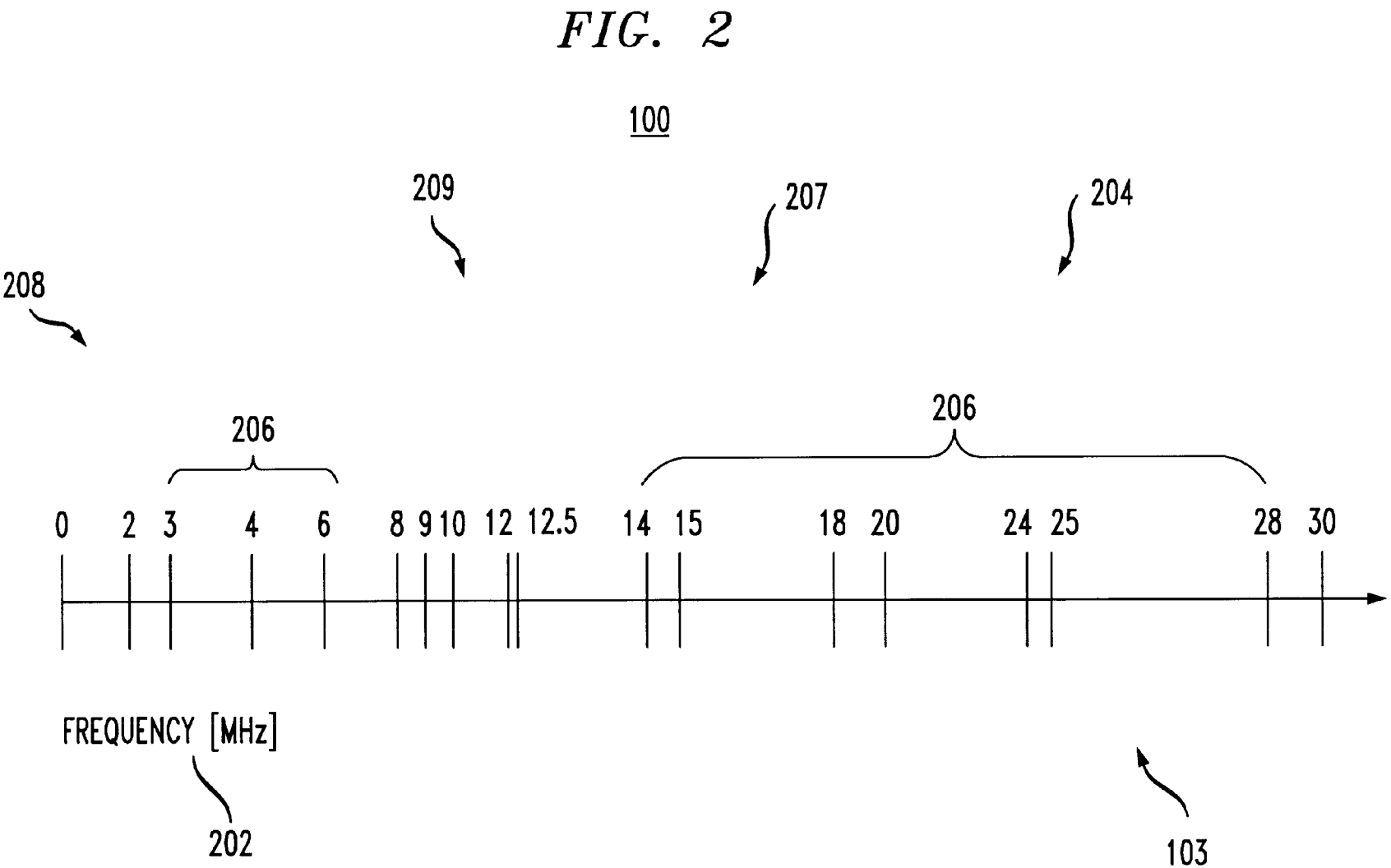
FIG. 2 represents one or more frequencies that are employable by one example of one or more instances of the radiator component of the system of FIG. 1 for communication of information.

Now referring to FIGS. 1 and 2, a plurality of instances of radiator component 102 in one example serves to transmit information 103 over a plurality of frequencies 202, for example, in an instance of range 204 that comprises one or more octaves 206, for example, less than or equal to thirty megahertz ("MHz"). For example, at least one plurality of frequencies 202 in an exemplary instance of range 204 that comprises one or more octaves 206 less than or equal to thirty megahertz, in one example is employable for transmission of information 103 by an exemplary plurality of instances of radiator component 102. In a further example, a plurality of instances of radiator component 102 serves to transmit information 103 over any plurality of frequencies 202, for example, in an instance of range 204 that comprises one or more octaves 206, for example, less than or equal to thirty megahertz. For example, every plurality of frequencies 202 in an exemplary instance of range 204 that comprises one or more octaves 206 less than or equal to thirty megahertz, in one example is employable (e.g., each at a selected time) for transmission of information 103 by an exemplary plurality of instances of radiator component 102.

Referring again to FIGS. 1 and 2, in one example, a plurality of instances of radiator component 102 serves to transmit information 103 over a plurality of frequencies 202 in an instance of range 204 of zero to thirty megahertz. In another example, a plurality of instances of radiator component 102 serves to transmit information 103 over a plurality of frequencies 202 in an instance of range 204 of two to thirty megahertz. In a further example, a plurality of instances of radiator component 102 serves to transmit information 103 over a plurality of frequencies 202 in an instance of range 204 that comprises one or more octaves 206 between two and thirty megahertz. In yet another example, a plurality of instances of radiator component 102 serves to transmit information 103 over any selected plurality of frequencies 202 in an instance of range 204 of two to thirty megahertz.

Referring still to FIGS. 1 and 2, information 103 in one example comprises information that is employable by one or more instances of vessel 319 (FIG. 6), for example, to perform one or more surveillance and/or strategic communication operations.

Again referring to FIGS. 1 and 2, a plurality of instances of radiator component 102 in one example serves to transmit a first instance of information 103 over a first frequency 202 of a plurality of frequencies 202 in an instance of range 204 that comprises one or more octaves 206 less than or equal to thirty megahertz, and serves to transmit a second instance of information 103 over a second frequency 202 of a plurality of frequencies 202 in an instance of range 204 that comprises one or more octaves 206 less than or equal to thirty megahertz. In one example, the first instance of information 103 comprises information that is different from the second instance of information 103. In another example, the first instance of information 103 and the second instance of information 103 comprise same information.

Still referring to FIGS. 1 and 2, octave 206 in one example comprises set 207 of frequencies 202 that differ by a factor of two. Exemplary instances of octave 206 comprise frequencies 202 of 2 and 4 megahertz, 3 and 6 megahertz, 4 and 8 megahertz, 4.8 and 9.6 megahertz, 9 and 18 megahertz, 12.5 and 25 megahertz, 14 and 28 megahertz, and 15 and 30 megahertz.

Referring again to FIGS. 1 and 2, range 204 in one example comprises a plurality of sub-ranges 208. In one example, a plurality of sub-ranges 208 comprises set 209 of sub-ranges 208. Set 209 of sub-ranges 208 in one example comprises a plurality of sub-ranges 208 that each comprise one or more octaves 206 less than or equal to thirty megahertz. System 100 in one example comprises a plurality of sets 209 of sub-ranges 208.

Still referring to FIG. 1, one exemplary set 209 of sub-ranges 208 that each comprise one or more octaves 206 less than or equal to thirty megahertz, comprises a first instance of sub-range 208 of 0 to 9 megahertz and a second instance of sub-range 208 of 9 to 30 megahertz. Another exemplary set 209 of sub-ranges 208 that each comprise one or more octaves 206 less than or equal to thirty megahertz, comprises a first instance of sub-range 208 of 2 to 9 megahertz and a second instance of sub-range 208 of 9 to 30 megahertz. A further exemplary set 209 of sub-ranges 208 that each comprise one or more octaves 206 less than or equal to thirty megahertz, comprises a first instance of sub-range 208 of 2 to 8.3 megahertz and a second instance of sub-range 208 of 9.6 to 15 megahertz. A still further exemplary set 209 of sub-ranges 208 that each comprise one or more octaves 206 less than or equal to thirty megahertz, comprises a first instance of sub-range 208 of 2 to 8 megahertz, a second instance of sub-range 208 of 8 to 15 megahertz, and a third instance of sub-range 208 of 15 to 28 megahertz. Yet another exemplary set of sub-ranges 208 that each comprise one or more octaves 206 less than or equal to thirty megahertz, comprises a first instance of sub-range 208 of 3 to 10 megahertz and a second instance of sub-range 208 of 16 to 30 megahertz.

Referring to FIGS. 1 and 3–6, system 100 in one example comprises a plurality of instances of set 113 of one or more instances of radiator component 102. For example, set 113 comprises one, two, three, or more instances of radiator component 102. Exemplary instances of set 113 comprise sets 312 and 314. In one example, radiator components 108 and 110 comprise set 312. In further example, radiator components 350 and 352 comprise set 314.

Referring to FIGS. 1–5, each set 113 of a plurality of sets 113 of one or more instances of radiator component 102 in one example serves to transmit information 103 in a respective sub-range 208 of a plurality of sub-ranges 208, over a respective set of one or more frequencies 202. In one example, radiator component 108 and radiator component 110 serve to transmit information 103 over a set of one or more frequencies 202 in a first instance of sub-range 208, and radiator component 350 and radiator component 352 serve to transmit information 103 over a set of one or more frequencies 202 in a second instance of sub-range 208.

Again referring to FIGS. 1–5, a first set 113 of one or more instances of radiator component 102 in one example serves to transmit information 103 in a first sub-range 208 over a first set of one or more frequencies 202 substantially contemporaneously (e.g., simultaneously) with transmission of information 103 in a second sub-range 208 over a second set of one or more frequencies 202 by a second set 113 of one or more instances of radiator component 102.

For example, referring to FIGS. 1–5, sets 312 and 314 in one example serve to transmit information 103 substantially contemporaneously (e.g., simultaneously) in respective sub-ranges 208 over respective sets of one or more frequencies 202. In one example, sets 312 and 314 serve to transmit one or more same instances of information 103. In another example, sets 312 and 314 serve to transmit one or more different instances of information 103. In a further example, sets 312 and 314 serve to transmit a same amount of information 103. In a still further example, sets 312 and 314 serve to transmit a different amount of information 103.

Now referring to FIGS. 5 and 6, a plurality of radiator components 102 is located in structural component 302. In one example, a plurality of sets 113 of one or more instances of radiator component 102 is located in structural component 302. Structural component 302 in one example comprises one or more instances of location 303. Exemplary instances of location 303 comprise locations 304, 306, 308, and 310. Instances of radiator component 102 in one example are located at locations 304, 306, 308, and 310. In one example, radiator component 108 is located at location 304, radiator component 110 is located at location 306, radiator component 350 is located at location 308, and radiator component 352 is located at location 310.

Further referring to FIG. 6, structural component 302 in one example is located on body 318. In a further example, structural component 302 comprises a selected position relative to body 318. For example, structural component 302 comprises any (e.g., selected) position relative to structural component 318. For instance, structural component 302 extends outwardly relative to body 318, for example, from any selected position of body 318. In one example, structural component 302 comprises a portion of body 318. For example, structural component 302 and body 318 are integral. In another example, structural component 302 comprises a structural component separate and/or distinct from body 318. In a further example, structural component 302 comprises a structure connected with and/or fixed to body 318.

Referring still to FIG. 6, body 318 in one example comprises vessel 319, for example, an air-based, land-based, or water-based vehicle, for instance, a ship such as a surface combatant of a navy. Structural component 302 in one example serves to promote a decrease in radar cross section ("RCS") 320 of body 318. A plurality of instances of radiator component 102 in one example is embedded in structural component 302. For example, a plurality of instances of radiator component 102 serve to serve to promote and/or allow stealth operation of structural component 302 and/or body 318. In one example, one or more instances of radiator component 102 advantageously serve promote a decrease in detectability of structural component 302 and/or body 318, for example, by enemy and/or competitive forces.

Again referring to FIG. 6, structural component 302 in one example exhibits (e.g., relatively) low detectability by enemy forces. A plurality of instances of radiator component 102 in one example comprises an antenna array, for example, that allows structural component 302 to act as a host for communication antennas. The antenna array in one example possess one or more characteristics that allow the antenna array to be placed within or upon structural component 302 while maintaining an overall low electronic visibility and/or low radar cross section 320, for example, of structural component 302 and/or body 318.

Figure 7:
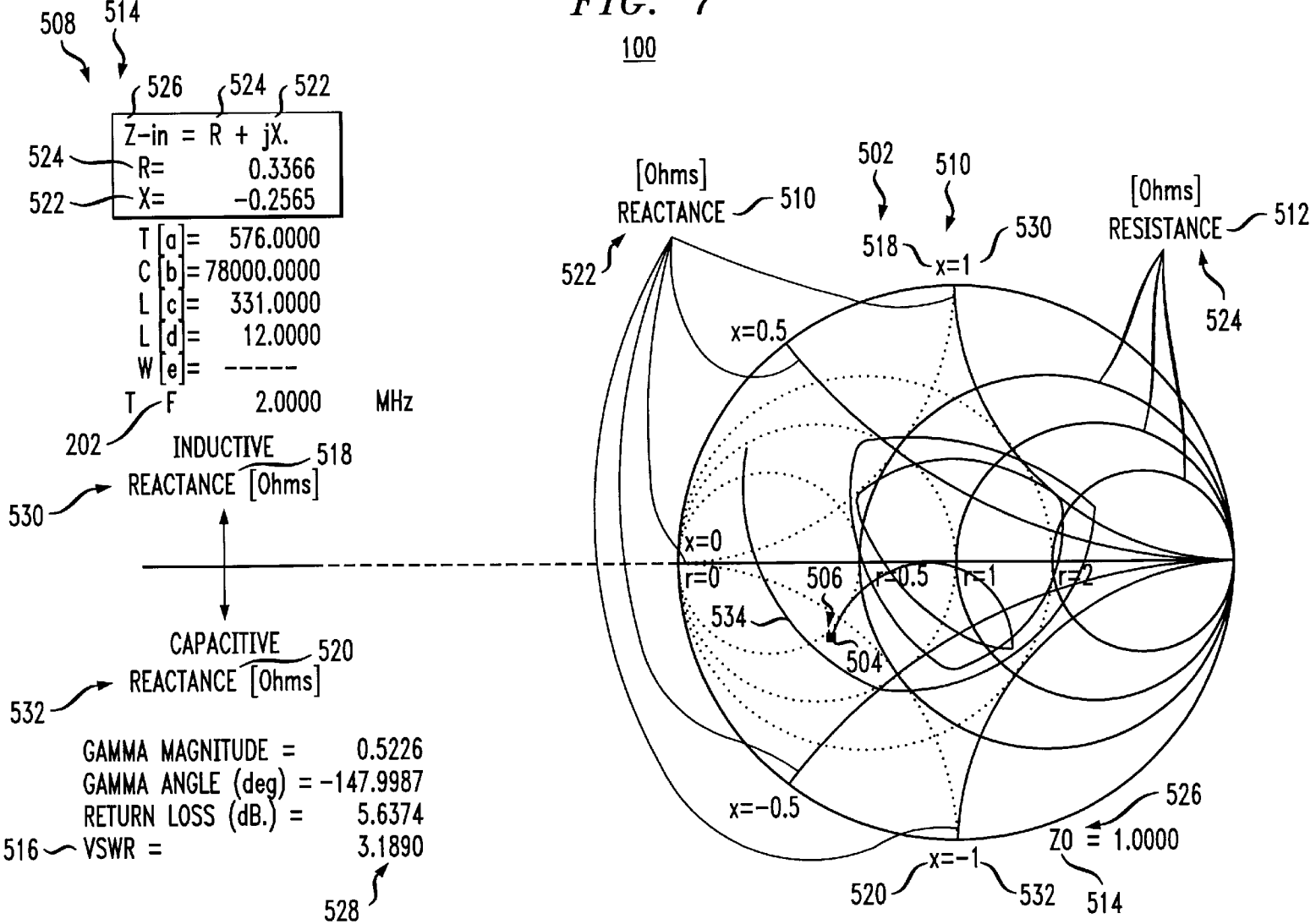
FIGS. 7–15 are graphical representations that include a marker, a reactance indicator, a resistance indicator, an impedance indicator, a voltage standing wave ratio ("VSWR") indicator, and a trace of the system of FIG. 1.

Turning to FIG. 7, graphical representation 502 in one example comprises marker 504. Marker 504 in one example serves to indicate a location in graphical representation 502 that corresponds to a measurement taken at location 506 for a certain instance of frequency 202. Referring to FIGS. 1 and 7, location 506 in one example comprises a location at source 106. In one example, marker 504 serves to indicate a location in graphical representation 502 that corresponds to a measurement taken at a location at source 106 for a certain instance of frequency 202.

Further referring to FIG. 7, in one example, graphical representation 502 comprises a number of instances of indication 508. Exemplary instances of indication 508 comprise marker 504, reactance indicator 510, resistance indicator 512, impedance indicator 514, voltage standing wave ratio ("VSWR") indicator 516 (FIG. 15), and trace 534. Exemplary instances of reactance indicator 510 comprise inductive reactance indicator 518 and capacitive reactance indicator 520. Inductive reactance indicator 518 in one example comprises a positive value of reactance indicator 510. Capacitive reactance indicator 520 in one example comprises a negative value of reactance indicator 510, as will be appreciated by those skilled in the art.

Still referring to FIG. 7, reactance indicator 510 in one example serves to indicate reactance 522, for example, for one or more components of system 100. Resistance indicator 512 in one example serves to indicate resistance 524, for example, for one or more components of system 100. Impedance indicator 514 in one example serves to indicate impedance 526, for example, for one or more components of system 100. Voltage standing wave ratio indicator 516 (FIG. 15) in one example serves to indicate voltage standing wave ratio 528 (FIG. 15), for example, for one or more components of system 100. Inductive reactance indicator 518 in one example serves to indicate inductive reactance 530, for example, for one or more components of system 100. Capacitive reactance indicator 520 in one example serves to indicate capacitive reactance 532, for example, for one or more components of system 100, as will be appreciated by those skilled in the art.

Figure 8:
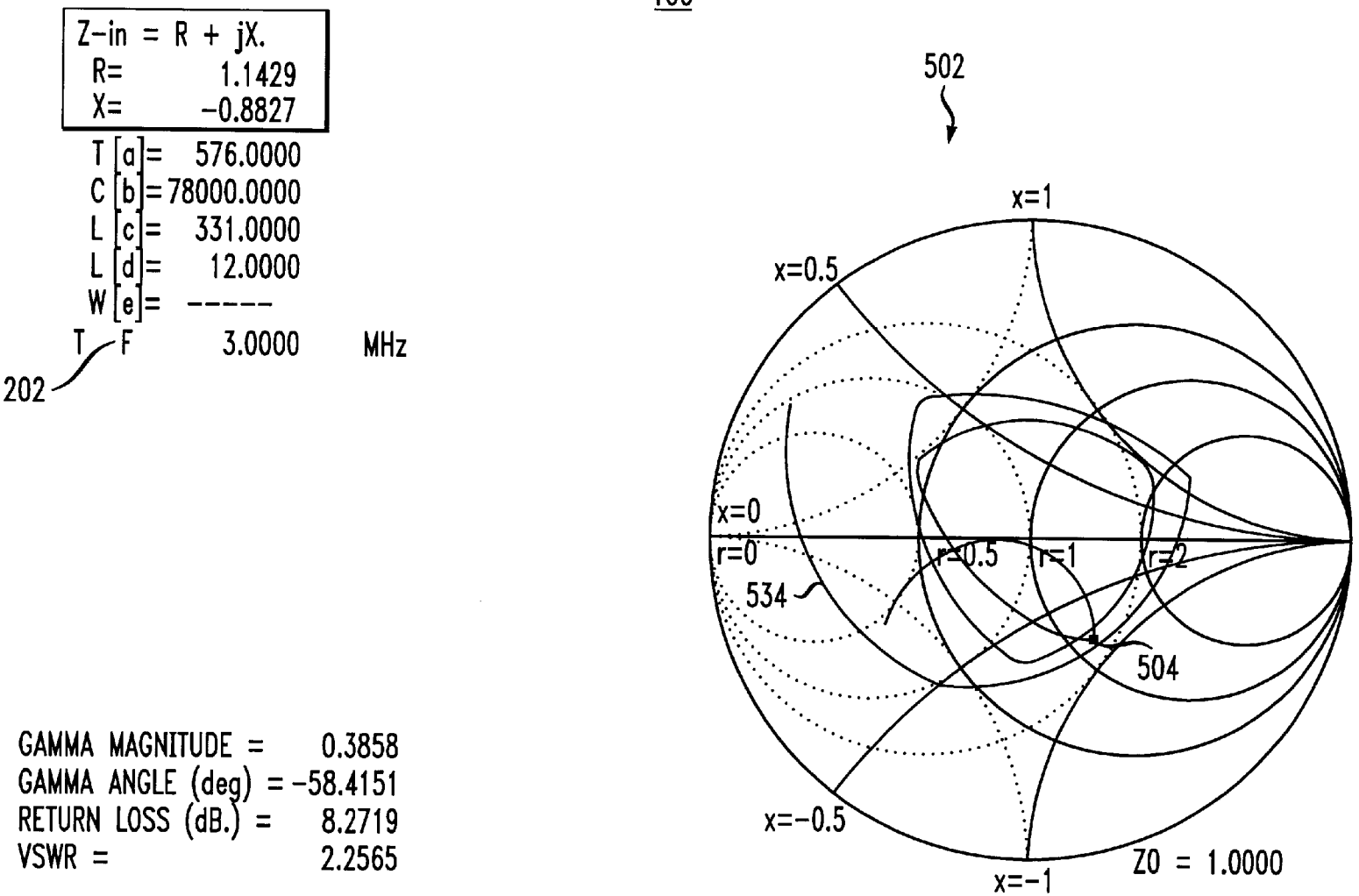
Figure 9:
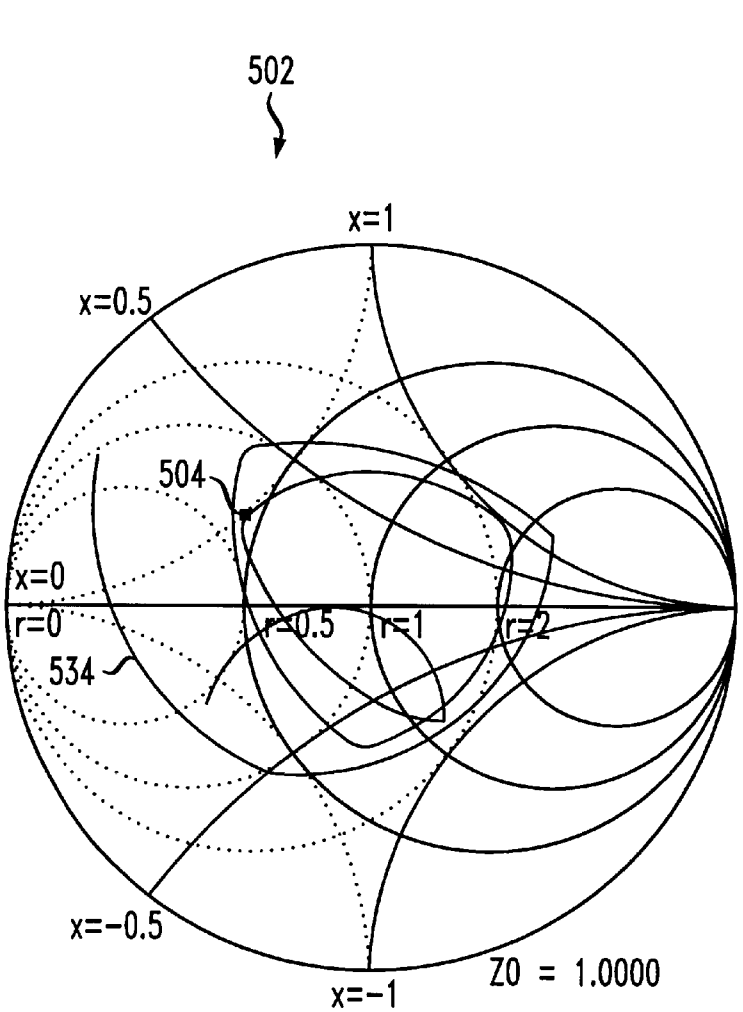
Figure 10:
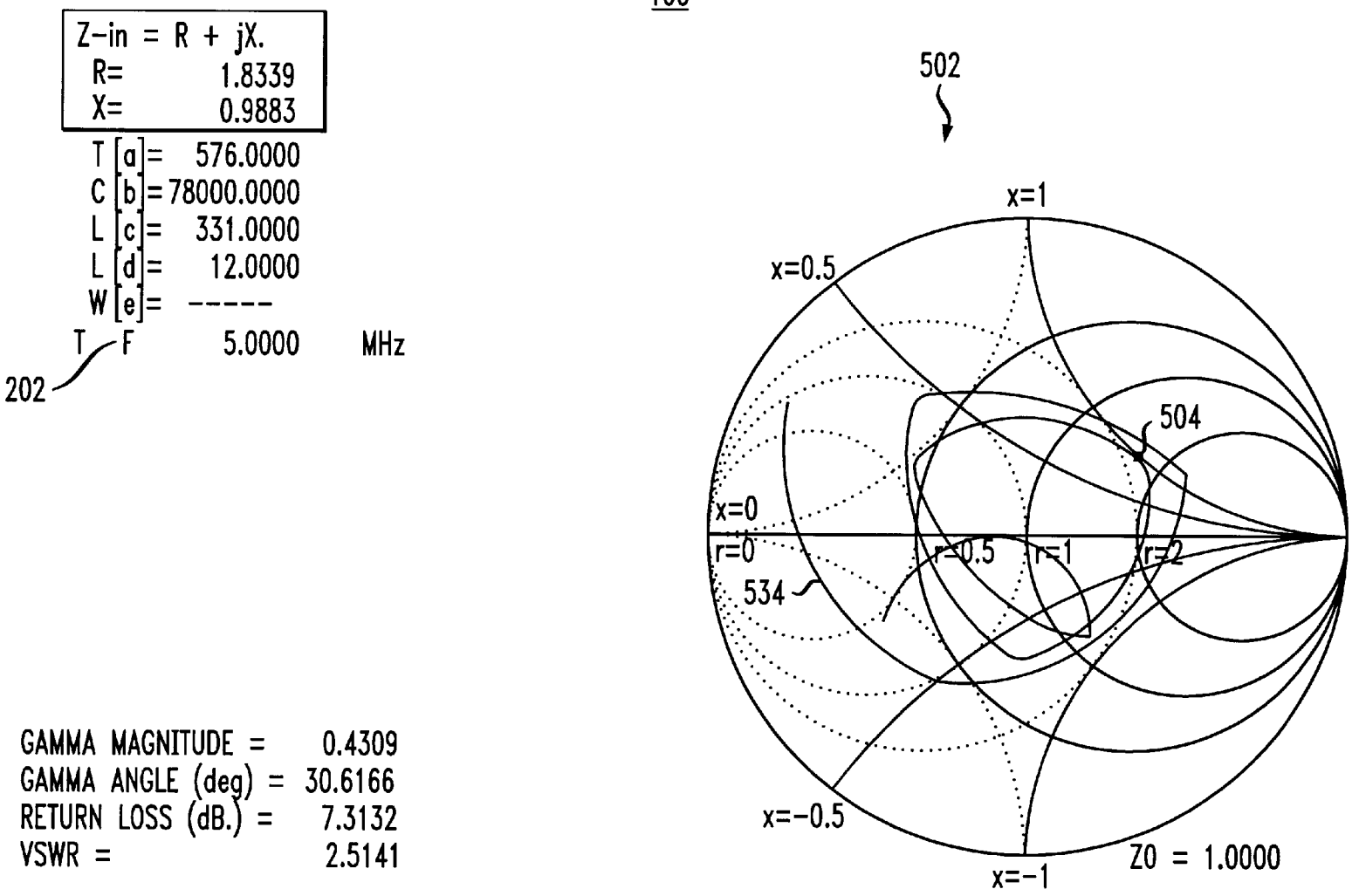
Figure 11:
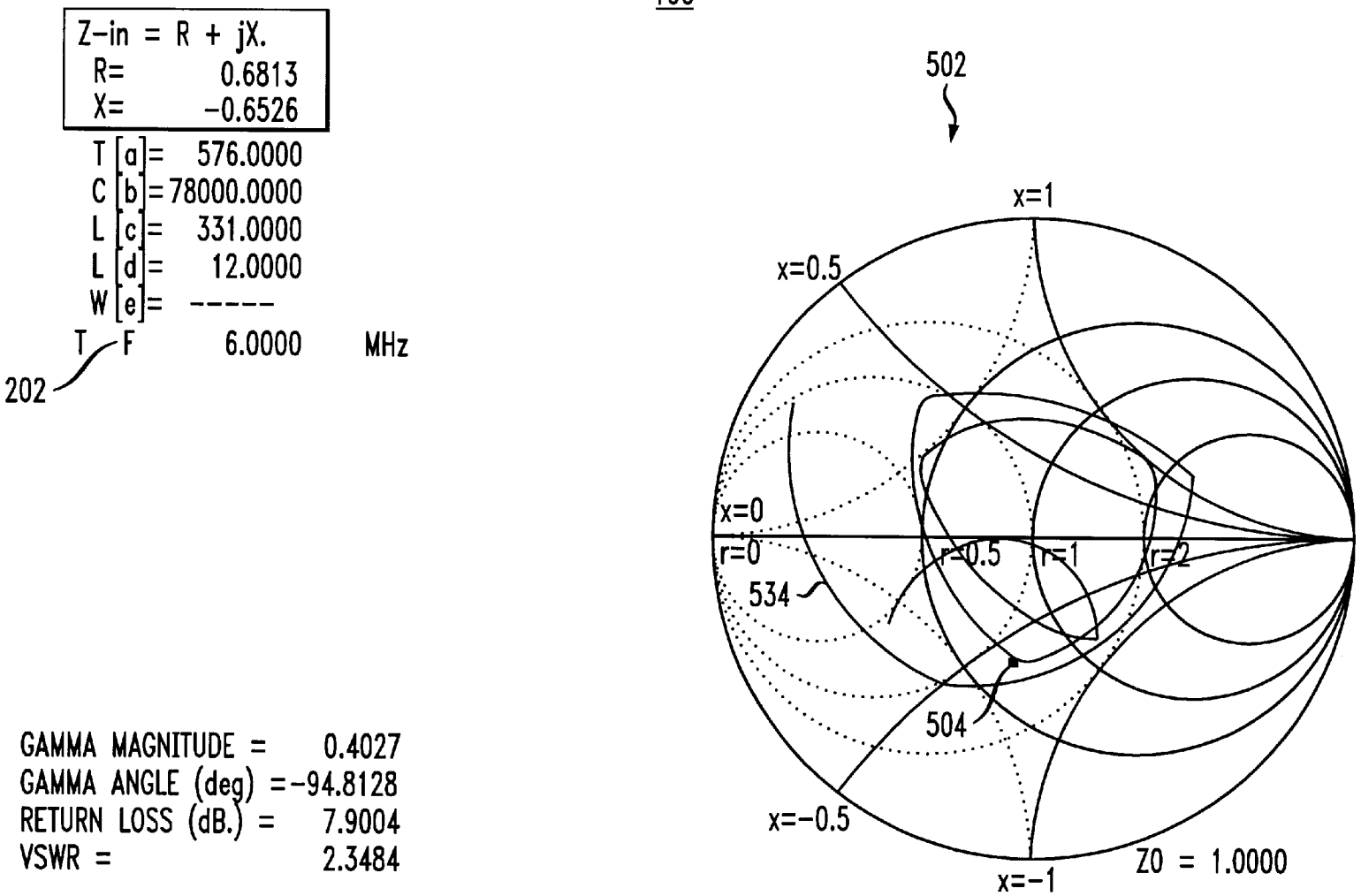
Figure 12:
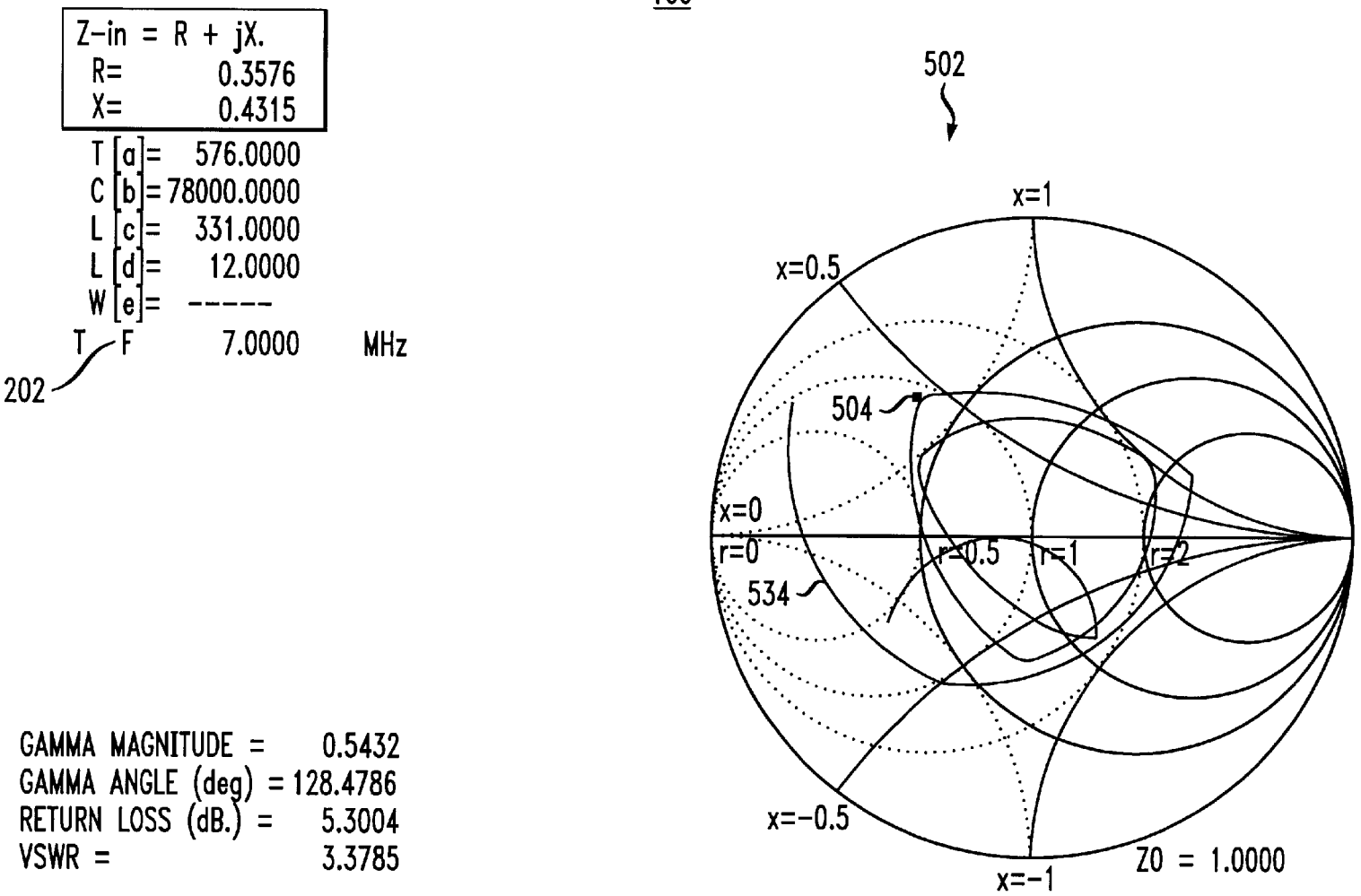
Figure 13:
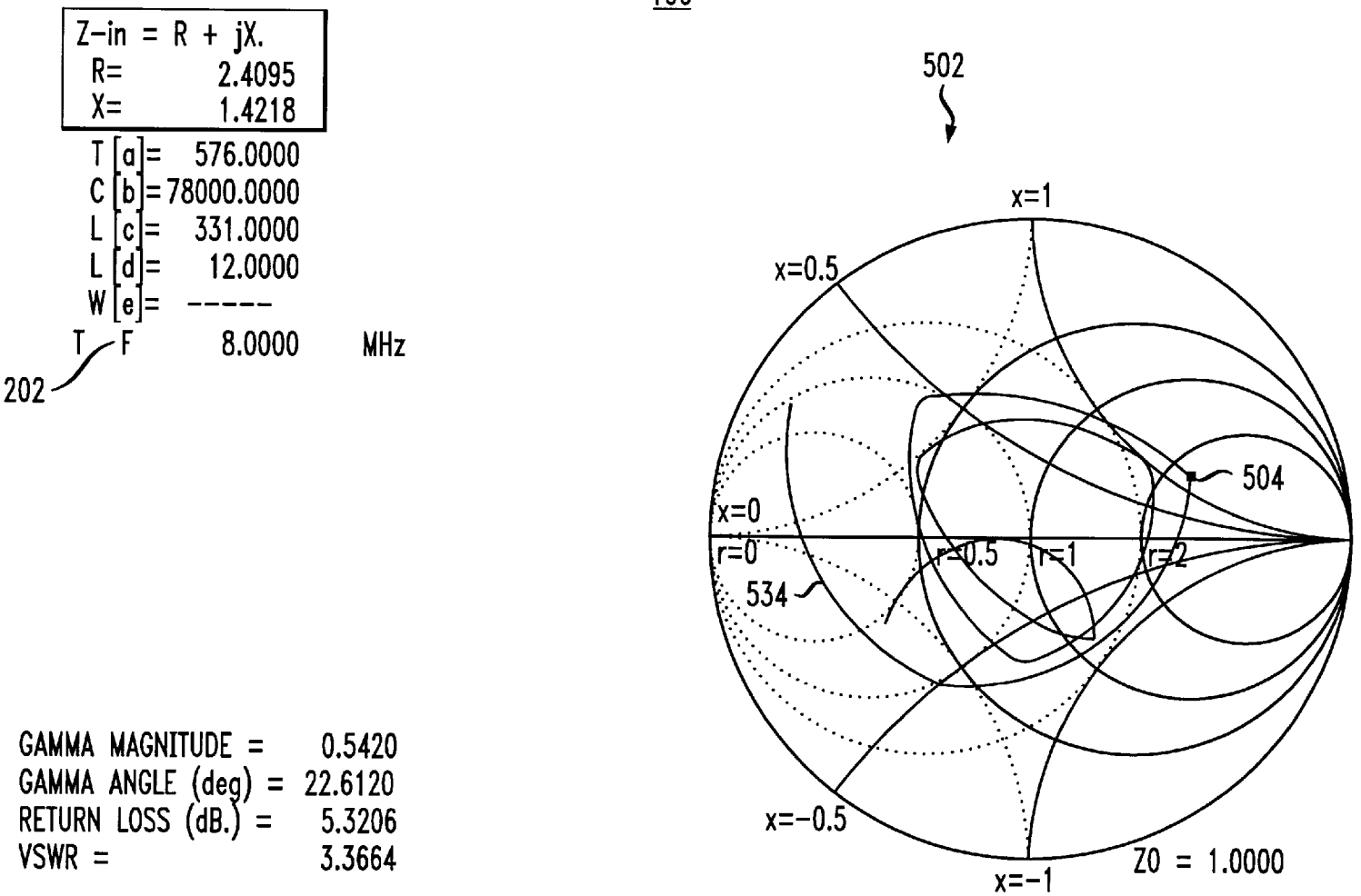
Figure 14:
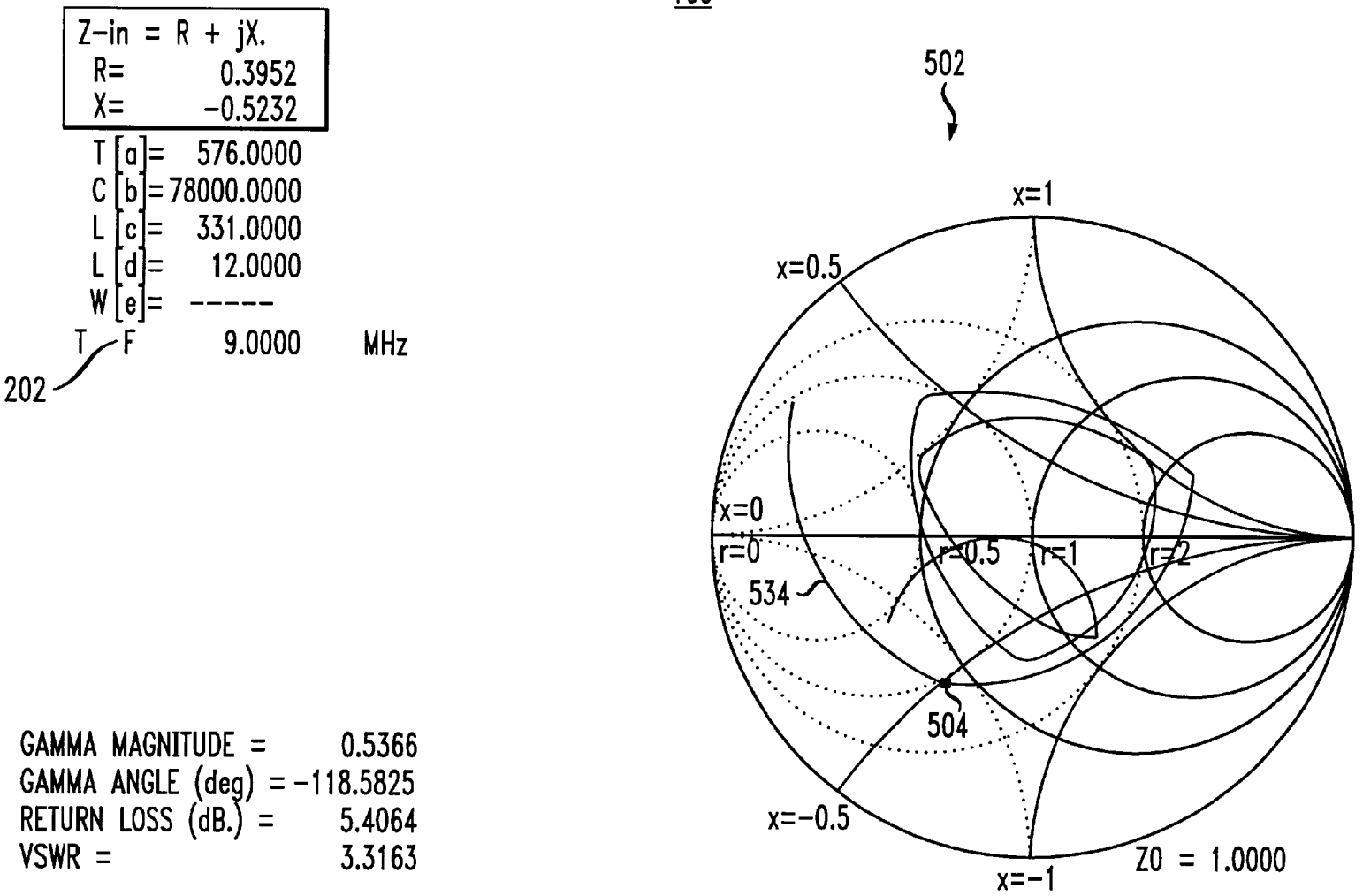
Figure 15:
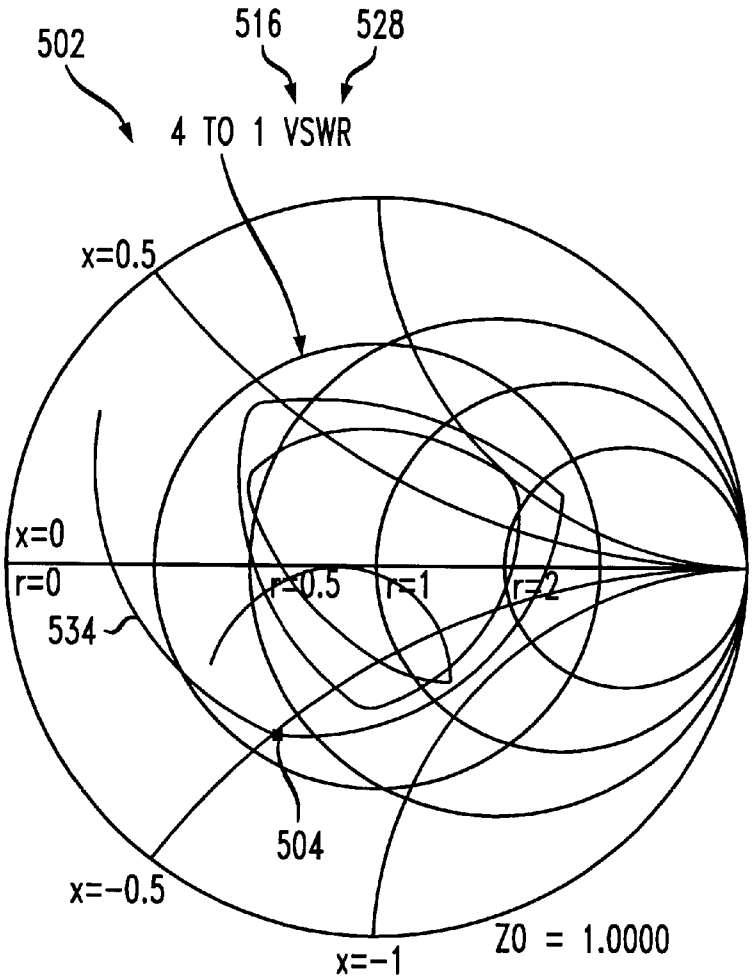

Referring to FIGS. 7–15, marker 504 in one example serves to plot trace 534, for example, for a plurality of instances of frequency 202. In FIG. 7, marker 504 of graphical representation 502 corresponds to an instance of frequency 202 of 2 megahertz. In FIG. 8, marker 504 of graphical representation 502 corresponds to an instance of frequency 202 of 3 megahertz. In FIG. 9, marker 504 of graphical representation 502 corresponds to an instance of frequency 202 of 4 megahertz. In FIG. 10, marker 504 of graphical representation 502 corresponds to an instance of frequency 202 of 5 megahertz. In FIG. 11, marker 504 of graphical representation 502 corresponds to an instance of frequency 202 of 6 megahertz. In FIG. 12, marker 504 of graphical representation 502 corresponds to an instance of frequency 202 of 7 megahertz. In FIG. 13, marker 504 of graphical representation 502 corresponds to an instance of frequency 202 of 8 megahertz. In FIGS. 14–15, marker 504 of graphical representation 502 corresponds to an instance of frequency 202 of 9 megahertz.

Referring to FIGS. 1 and 7–15, for instance, one selects one or more values for one or more components of system 100 and obtains a corresponding instance of trace 534, for example, for a plurality of instances of frequency 202. One or more of a designer, implementer, operator, and user of system 100 in one example performs such selection of one or more values to obtain one or more instances of trace 534. For example, one selects one or more relationships among one or more components of system 100, for instance, to obtain one or more preselected characteristics and/or values of system 100.

Referring to FIGS. 1 and 7, in one example, one selects a complementary relationship among one or more instances of portion 112 of network 104. In one example, one selects lengths for transmission lines 122 and 126 that sum to a length of transmission line 134.

Referring still to FIGS. 1 and 7, for example, one selects a first portion 112 (e.g., portion 114) to comprise a first impedance 526 that comprises a preselected relationship with a second impedance 526 of a second portion 112 (e.g., portion 116). The preselected relationship in one example serves to promote a (e.g., approximate) match between an overall impedance 526 of a plurality of instances of radiator component 102 and an impedance 526 of transmitter component 106.

Further referring to FIGS. 1 and 7, network 104 in one example comprises a plurality of portions 112 that comprise respective impedances 526. For example, one selects the impedances 526 to comprise a preselected interrelationship. The preselected interrelationship in one example serves to promote a (e.g., approximate) match between an overall impedance of the plurality of radiator components and an impedance of the transmitter component Again referring to FIGS. 1 and 7, one selects a first portion 112 (e.g., portion 114) in one example to comprise a preselected relationship with a second portion 112 (e.g., portion 116). In one example, the preselected relationship comprises a first sum of a first resistance 524 of the first portion 112 with a second resistance 524 of the second portion 112 to approximately a preselected first value. In a further example, the preselected relationship comprises a second sum of a first reactance 522 of the first portion 112 with a second reactance 522 of the second portion 112 to approximately a preselected second value. The first sum and the second sum in one example serve to promote a (e.g., approximate) match between an overall impedance 526 of a plurality of radiator components 102 and an impedance 526 of transmitter component 106.

For example, referring to FIGS. 1 and 7, capacitive reactance 532 of a first instance of portion 112 in one example serves to (e.g., approximately) cancel inductive reactance 530 of a second instance of portion 112. In a still further example, resistance 524 of a first instance of portion 112 and resistance 524 of a second instance of portion 112 sum to a selected value. For example, resistance 524 of portion 114, resistance 524 of portion 116 and resistance 524 of portion 118 in one example serve to combine to a selected value of resistance 524, for instance, that (e.g., approximately) matches resistance 524 of source 106.

Still referring to FIGS. 1 and 7, a plurality of portions 112 in one example comprise respective resistances 524 and respective reactances 522. For example, one selects the resistances 524 to comprise a preselected first interrelationship. In a further example, one selects the reactances 522 to comprise a preselected second interrelationship. The preselected first interrelationship and the preselected second interrelationship in one example serve to promote a (e.g., approximate) match between an overall impedance 526 of a plurality of instances of radiator component 102 and an impedance 526 of transmitter component 106.

Referring again to FIGS. 1 and 7 network 104 in one example serves to present to transmitter component 106 a selected voltage standing wave ratio 528 (FIG. 15). In one example, network 104 serves to present to transmitter component 106 a voltage standing wave ratio 528 of less than or equal to 5/1 ("five to one"). In a further example, network 104 serves to present to transmitter component 106 a voltage standing wave ratio 528 of less than or equal to 4/1 ("four to one").

Figure 16:
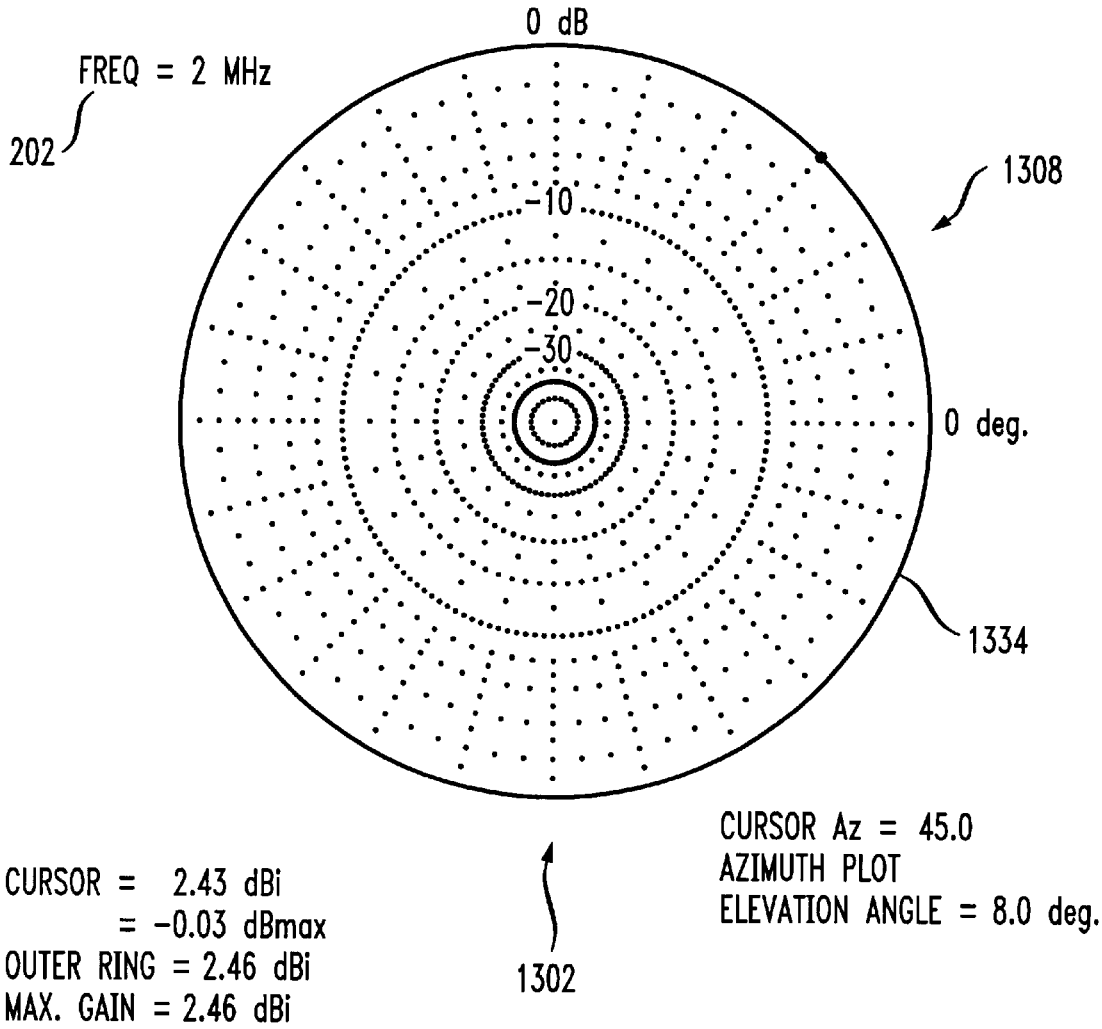
FIGS. 16–23 are graphical representations that include a plot of the system of FIG. 1.
Figure 17:
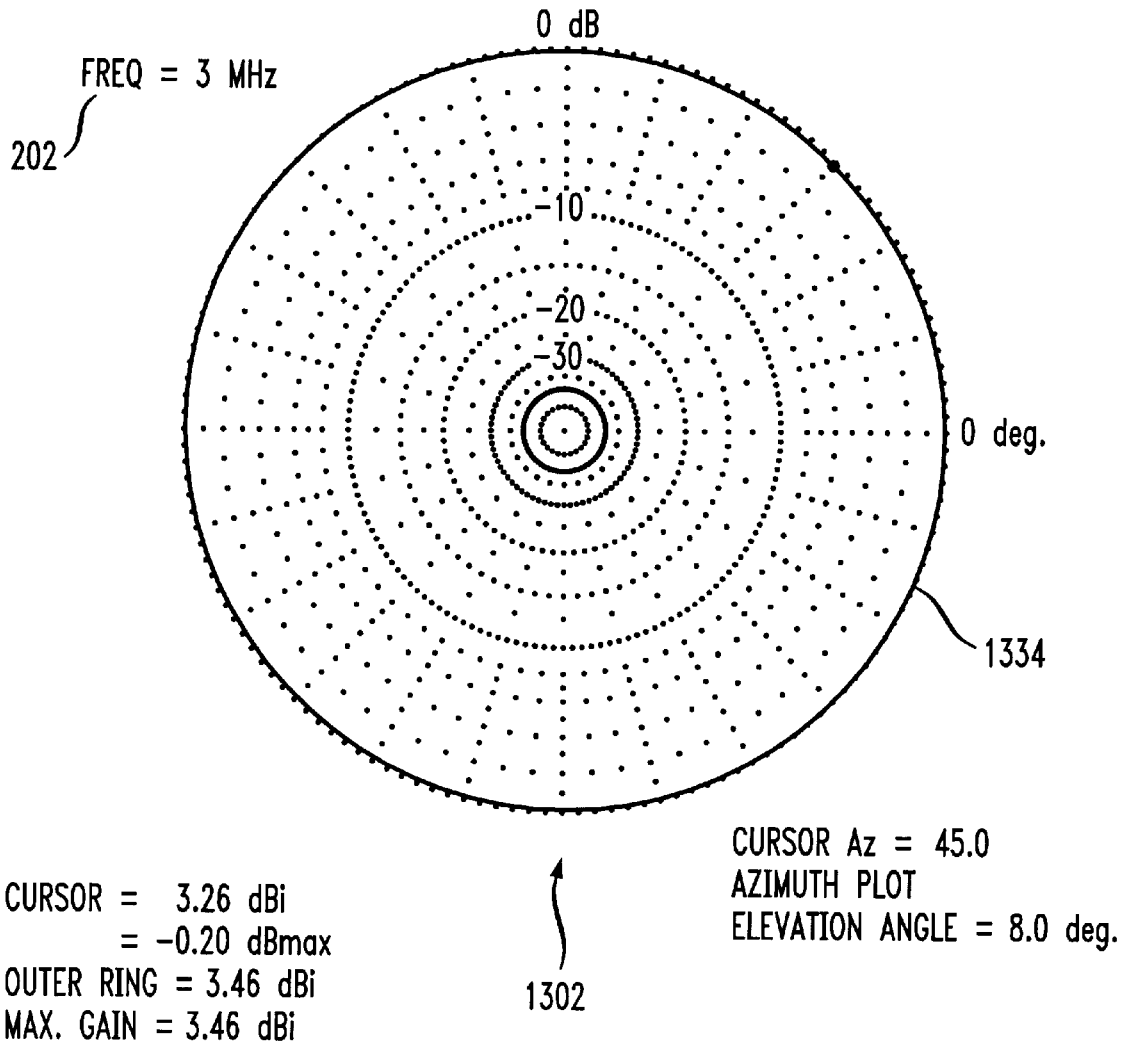
Figure 18:
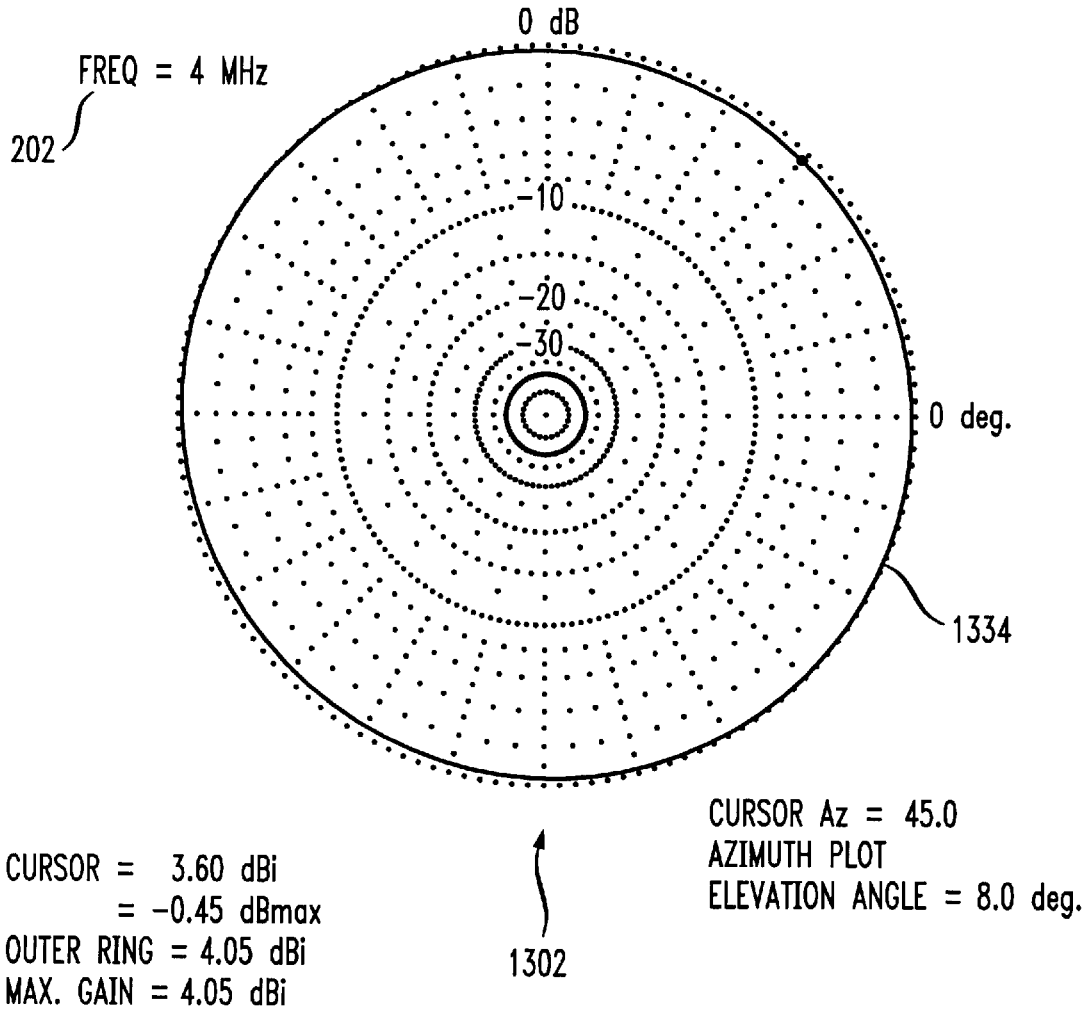
Figure 19:
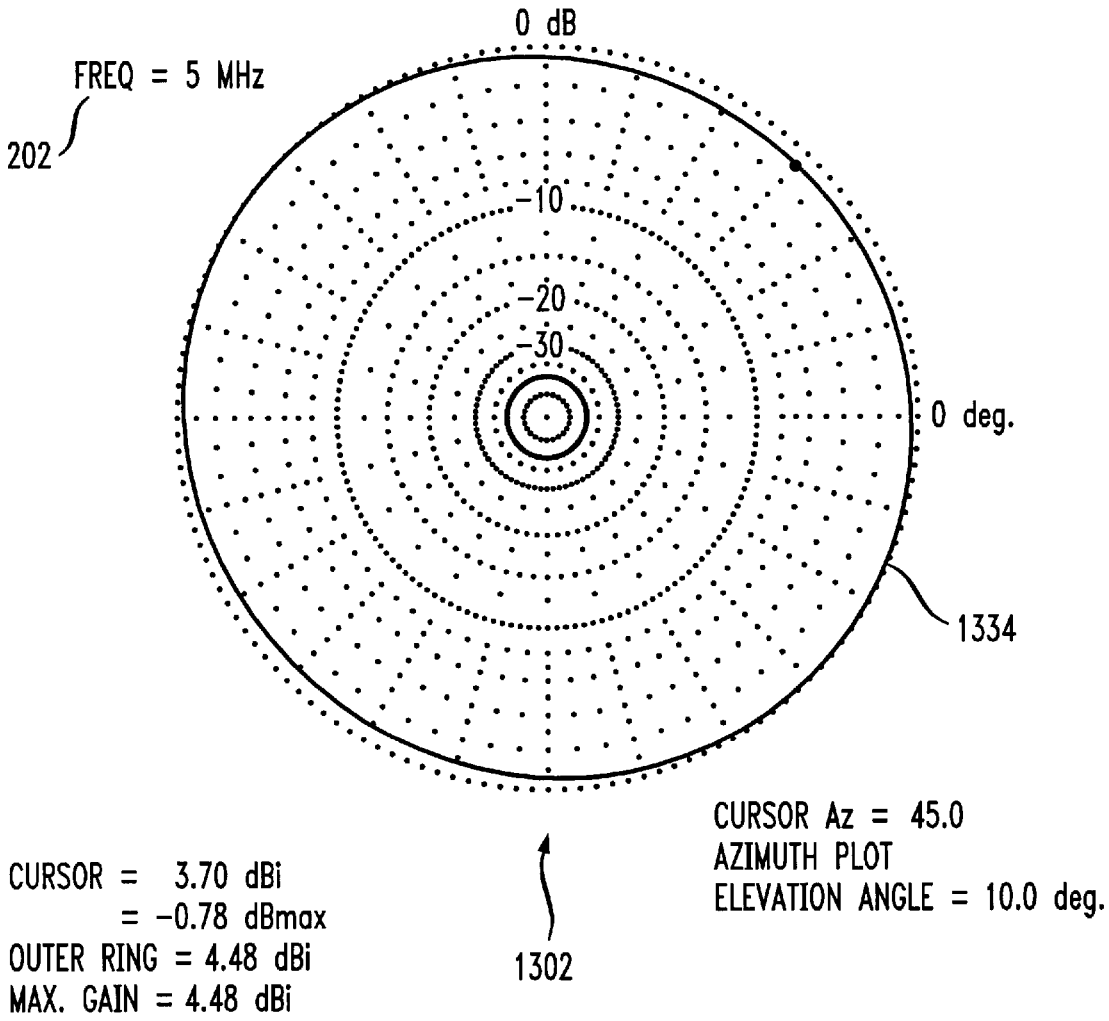
Figure 20:
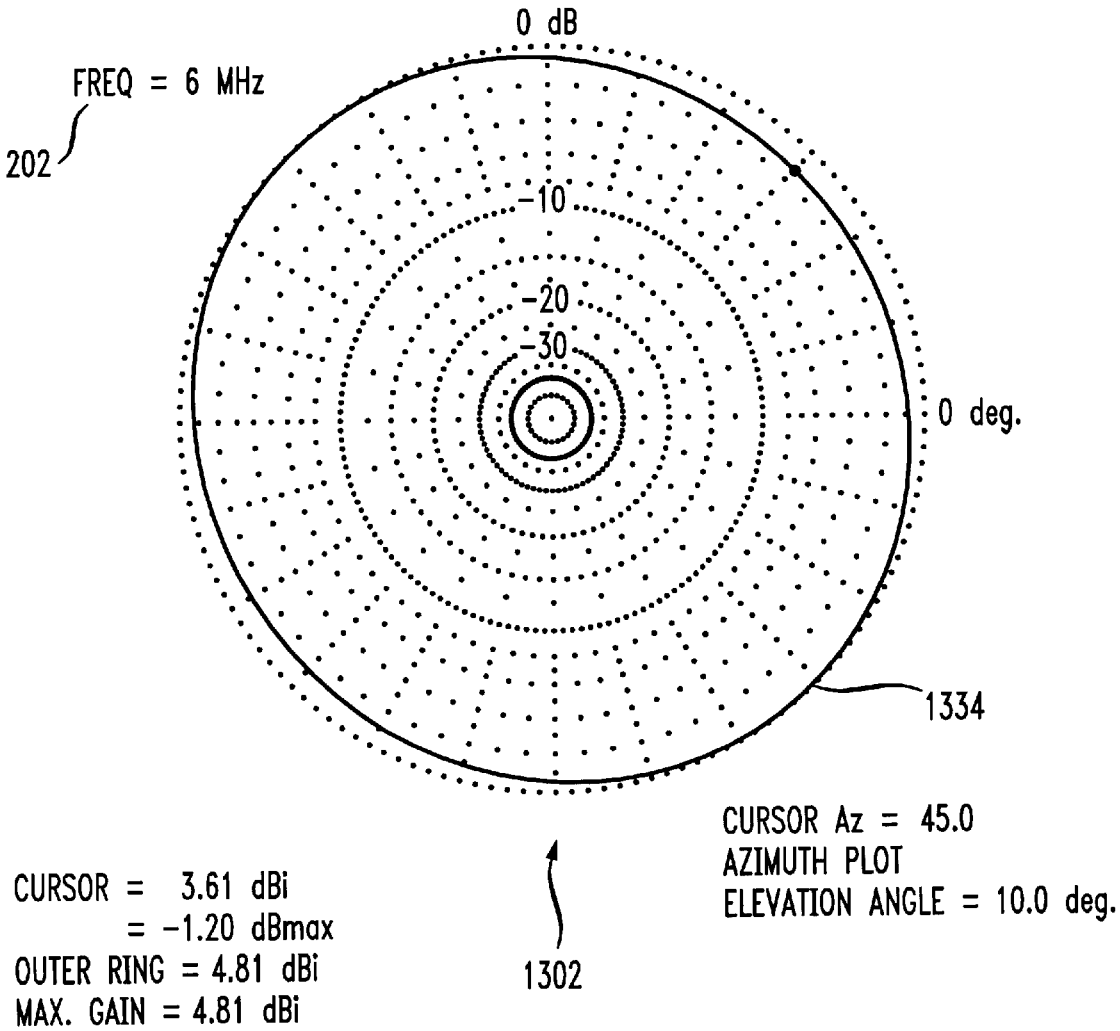
Figure 21:
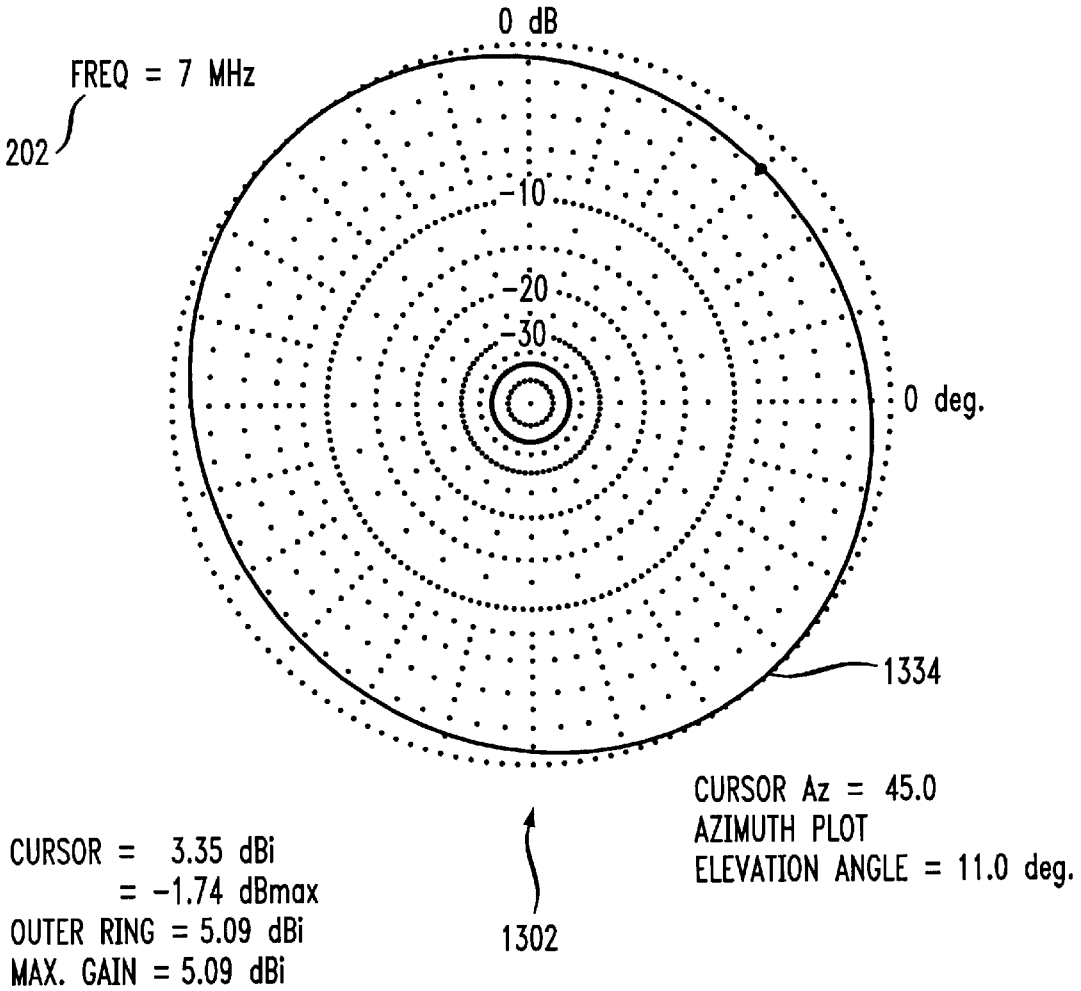
Figure 22:
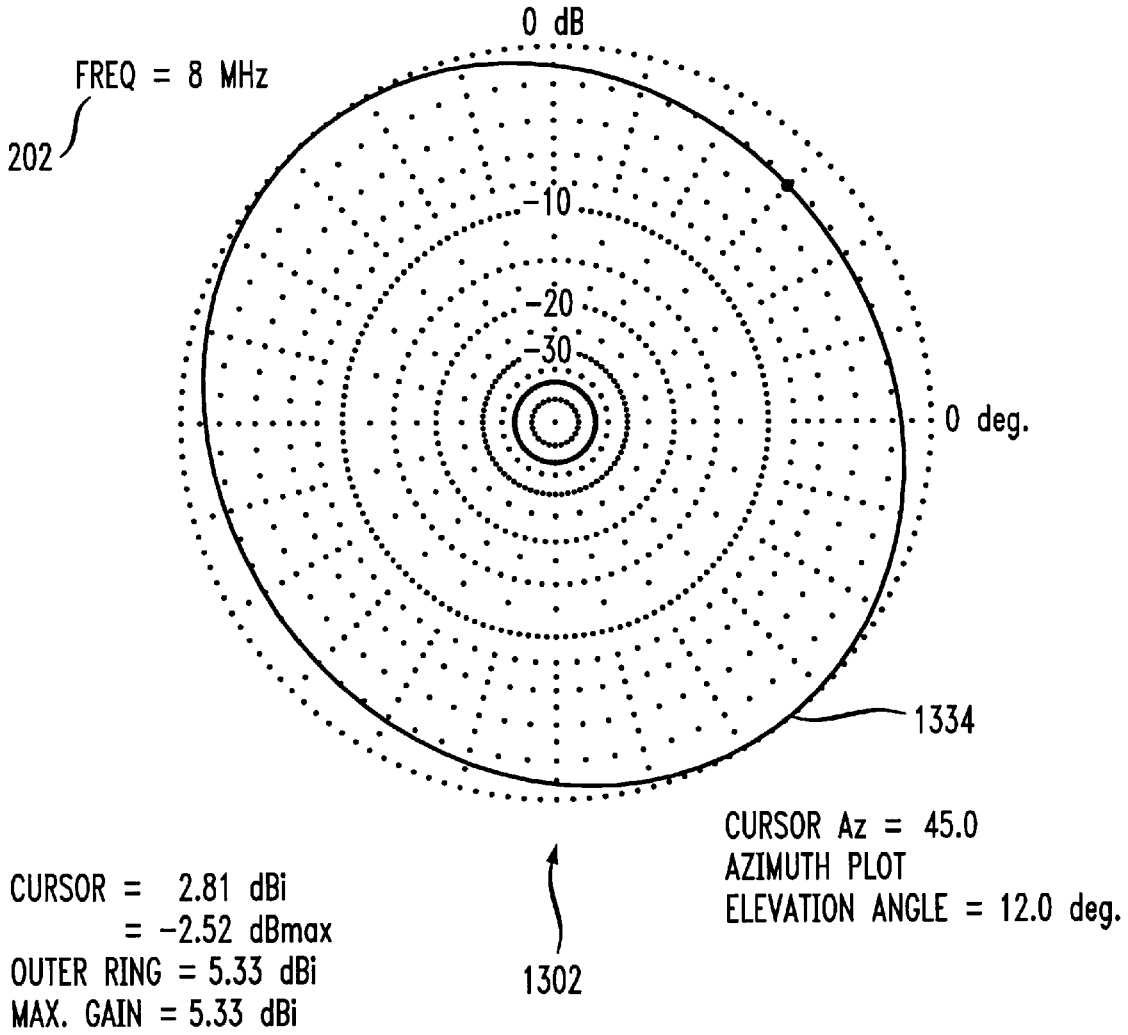
Figure 23:
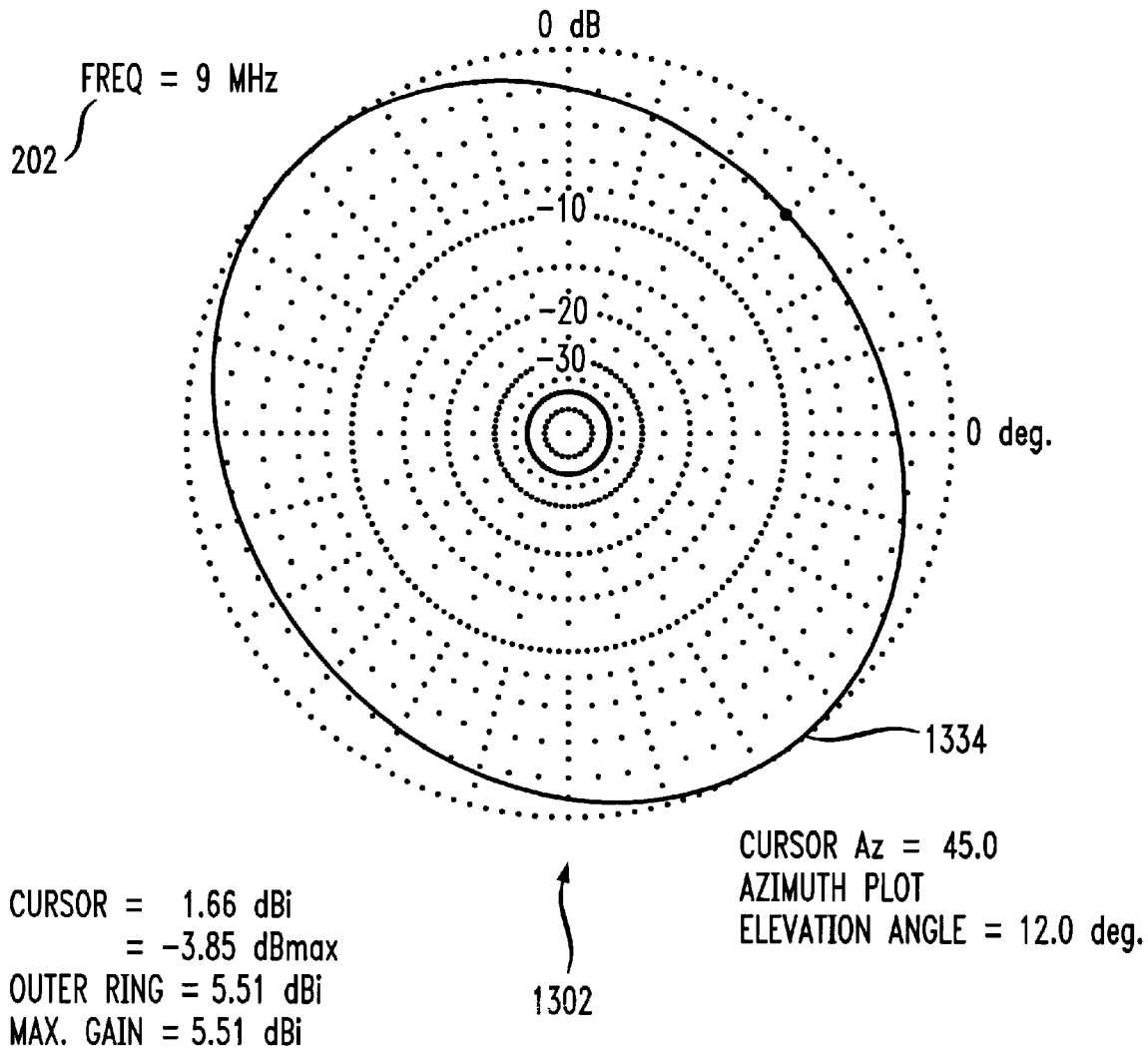

Now referring to FIGS. 2, 6, and 16, a plurality of instances of radiator component 102 in one example serves to allow transmission of information 103 in one or more instances of direction 322, for example, relative to a particular instance of location 324 over a plurality of frequencies 202, for example, in an instance of range 204 that comprises one or more octaves 206 less than or equal to thirty megahertz. For example, a plurality of instances of radiator component 102 allows transmission of information 103 in (e.g., substantially) all instances of direction 322 relative to a particular instance of location 324 over a plurality of frequencies 202 in an instance of range 204 that comprises one or more octaves 206 less than or equal to thirty megahertz. In one example, the particular instance of location 324 comprises an instance of location 303 of structural component 302. In another example, the particular instance of location 324 comprises a relative location (e.g., a geometric center of an arrangement, for example, an array) of the plurality of instances of radiator component 102. In another example, the particular instance of location 324 comprises a location on or in body 318.

Further referring to FIG. 16, graphical representation 1302 in one example comprises a number of instances of indication 1308. One exemplary instance of indication 1308 comprises plot 1334, for example, for a particular instance of frequency 202. Plot 1334 in one example serves to represent an exemplary extent of communication, for example, transmission coverage, as will be appreciated by those skilled in the art.

Referring to FIGS. 6 and 16–23, graphical representation 1302 in one example serves to indicate that a plurality of instances of radiator component 102 that comprise an antenna array serve to provide communication throughout 360 degrees of azimuth around body 318 (e.g., vessel 319). Plots 1334 of FIGS. 16–23 in one example comprise azimuth plots calculated at each prime frequency, and serve to indicate that system 100 advantageously maintains a satisfactory azimuth pattern over an entire operating range that is wide and through employment of a plurality of instances of radiator component 102, as will be appreciated by those skilled in the art.

Referring again to FIGS. 6 and 16–23, instances of plot 1334 for a plurality of instances of frequency 202 in one example serve to illustrate that system 100 at the plurality of instances of frequency 202 allows transmission of information 103 in (e.g., substantially) all instances of direction 322 relative to one or more particular instances of location 324, as will be appreciated by those skilled in the art. For example, system 100 serves to provide omnidirectional coverage relative to one or more particular instances of location 324.

Although exemplary embodiments of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. A system, comprising:

a first radiator component and a second radiator component that serve to transmit information over a plurality of frequencies in a range that comprises one or more octaves less than or equal to thirty megahertz, wherein the first radiator component comprises a major dimension that is less than or equal to nine meters, and wherein the second radiator component comprises a major dimension that is less than or equal to nine meters;

wherein the first radiator component and the second radiator component serve to transmit information over the plurality of frequencies contemporaneously.

2. The system of claim 1, wherein the first radiator component and the second radiator component that serve to transmit information over the plurality of frequencies in the range that comprises one or more octaves less than or equal to thirty megahertz comprise:

a plurality of radiator components that serves to transmit information over the plurality of frequencies in the range that comprises one or more octaves less than or equal to thirty megahertz, wherein each of the plurality of radiator components comprises a major dimension that is less than or equal to nine meters.

3. The system of claim 1, wherein the plurality of frequencies comprises a first frequency and a second frequency, wherein the first frequency is different from the second frequency, wherein the first radiator component and the second radiator component that serve to transmit information over the plurality of frequencies in the range that comprises one or more octaves less than or equal to thirty megahertz comprise:

a plurality of radiator components that serves to transmit first information over the first frequency and serves to transmit second information over the second frequency.

4. The system of claim 3, wherein the first information and the second information comprise same information.

5. The system of claim 1, wherein the major dimension is greater than or equal to two meters and less than or equal to six meters.

6. The system of claim 1, wherein the first radiator component and the second radiator component that serve to transmit information over the plurality of frequencies in the range that comprises one or more octaves less than or equal to thirty megahertz comprise:

a plurality of radiator components that serves to transmit information over a plurality of frequencies in a range of two to thirty megahertz.

7. The system of claim 1, wherein the first radiator component and the second radiator component that serve to transmit information over the plurality of frequencies in the range that comprises one or more octaves less than or equal to thirty megahertz comprise:

a plurality of radiator components that serves to transmit information over any selected plurality of frequencies in a range of two to thirty megahertz.

8. The system of claim 1, wherein the range that comprises one or more octaves less than or equal to thirty megahertz comprises at least a first sub-range and a second sub-range that each comprise one or more octaves less than or equal to thirty megahertz, wherein the first sub-range is different from the second sub-range, wherein the first radiator component and the second radiator component that serve to transmit information over the plurality of frequencies in the range that comprises one or more octaves less than or equal to thirty megahertz comprise:

a plurality of radiator components that serves to transmit information over one or more frequencies in the first sub-range and serves to transmit information over one or more frequencies in the second sub-range.

9. The system of claim 8, wherein the range that comprises one or more octaves less than or equal to thirty megahertz comprises at least the first sub-range, the second sub-range, and a third sub-range, wherein each of the first sub-range, the second sub-range, and the third sub-range comprises one or more octaves less than or equal to thirty megahertz, wherein the first sub-range is different from the third sub-range, wherein the second sub-range is different from the third sub-range, wherein the first radiator component and the second radiator component that serve to transmit information over the plurality of frequencies in the range that comprises one or more octaves less than or equal to thirty megahertz comprise:

a plurality of radiator components that serves to transmit information over one or more frequencies in the first sub-range, serves to transmit information over one or more frequencies in the second sub-range, and serves to transmit information over one or more frequencies in the third sub-range.

10. The system of claim 1, wherein the range that comprises one or more octaves less than or equal to thirty megahertz comprises a plurality of sub-ranges that each comprise one or more octaves less than or equal to thirty megahertz, wherein at least two sub-ranges of the plurality of sub-ranges are different from each other, wherein the first radiator component and the second radiator component that serve to transmit information over the plurality of frequencies in the range that comprises one or more octaves less than or equal to thirty megahertz comprise:

a plurality of sets of radiator components, wherein each set of the plurality of sets of radiator components serves to transmit information in a respective sub-range of the plurality of sub-ranges over a respective set of one or more frequencies, wherein at least one set of the plurality of sets of radiator components comprises at least two radiator components.

11. The system of claim 1, wherein the range that comprises one or more octaves less than or equal to thirty megahertz comprises at least a first sub-range and a second sub-range that each comprise one or more octaves less than or equal to thirty megahertz, wherein the first sub-range is different from the second sub-range;

wherein the first radiator component and the second radiator component serve to transmit information over one or more frequencies in the first sub-range;

further comprising a third radiator component and a fourth radiator component, wherein the third radiator component and the fourth radiator component serve to transmit information over one or more frequencies in the second sub-range.

12. The system of claim 1, wherein the first radiator component and the second radiator component that serve to transmit information over the plurality of frequencies in the range that comprises one or more octaves less than or equal to thirty megahertz comprise:

a plurality of radiator components that is embedded in a structural component that serves to promote a decrease in radar cross section of a body.

13. The system of claim 1, wherein the first radiator component and the second radiator component that serve to transmit information over the plurality of frequencies in the range that comprises one or more octaves less than or equal to thirty megahertz comprise:

a plurality of radiator components that allows transmission of information in substantially all directions relative to a particular location over the plurality of frequencies in the range that comprises one or more octaves less than or equal to thirty megahertz.

14. The system of claim 1, wherein the first radiator component and the second radiator component comprise a plurality of radiator components, and further comprising:

a network that serves to couple the plurality of radiator components with a transmitter component, wherein the network comprises at least a first portion and a second portion, wherein the first portion is different from the second portion, wherein the first portion is selected to comprise a first impedance that comprises a preselected relationship with a second impedance of the second portion, wherein the preselected relationship serves to promote an approximate match between an overall impedance of the plurality of radiator components and an impedance of the transmitter component.

15. The system of claim 1, wherein the first radiator component and the second radiator component comprise a plurality of radiator components, and further comprising:

a network that serves to couple the plurality of radiator components with a transmitter component, wherein the network comprises a plurality of portions that comprise respective impedances, wherein the impedances are selected to comprise a preselected interrelationship, wherein the preselected interrelationship serves to promote an approximate match between an overall impedance of the plurality of radiator components and an impedance of the transmitter component.

16. The system of claim 1, wherein the first radiator component and the second radiator component comprise a plurality of radiator components, and further comprising:

a network that serves to couple the plurality of radiator components with a transmitter component, wherein the network comprises a first portion and a second portion, wherein the first portion is different from the second portion, wherein the first portion is selected to comprise a preselected relationship with the second portion, wherein the preselected relationship comprises a first sum of a first resistance of the first portion with a second resistance of the second portion to approximately a preselected first value, wherein the preselected relationship comprises a second sum of a first reactance of the first portion with a second reactance of the second portion to approximately a preselected second value, wherein the first sum and the second sum serve to promote an approximate match between an overall impedance of the plurality of radiator components and an impedance of the transmitter component.

17. The system of claim 1, wherein the first radiator component and the second radiator component comprise a plurality of radiator components, and further comprising:

a network that serves to couple the plurality of radiator components with a transmitter component, wherein the network comprises a plurality of portions that comprise respective resistances and respective reactances, wherein the resistances are selected to comprise a preselected first interrelationship, wherein the reactances are selected to comprise a preselected second interrelationship, wherein the preselected first interrelationship and the preselected second interrelationship serve to promote an approximate match between an overall impedance of the plurality of radiator components and an impedance of the transmitter component.

18. The system of claim 1, wherein the first radiator component and the second radiator component comprise a plurality of radiator components, and further comprising:

a network that serves to couple the plurality of radiator components with a transmitter component, wherein the network serves to present to the transmitter component a voltage standing wave ratio of less than or equal to five to one.

19. The system of claim 1, wherein the first radiator component and the second radiator component comprise a plurality of radiator components, and further comprising:

a network that serves to couple the plurality of radiator components with a transmitter component, wherein the network serves to present to the transmitter component a voltage standing wave ratio of less than or equal to four to one.

20. A method, comprising the steps of:

selecting a first radiator component and a second radiator component that serve to transmit information over a plurality of frequencies in a range that comprises one or more octaves less than or equal to thirty megahertz;

selecting the first radiator component to comprise a major dimension that is less than or equal to nine meters; and selecting the second radiator component to comprise a major dimension that is less than or equal to nine meters;

wherein the first radiator component and the second radiator component serve to transmit information over the plurality of frequencies contemporaneously.

21. The method of claim 20, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the steps of:

selecting a plurality of radiator components that serves to transmit information over the plurality of frequencies in the range that comprises one or more octaves less than or equal to thirty megahertz; and selecting each of the plurality of radiator components to comprise a major dimension that is less than or equal to nine meters.

22. The method of claim 20, wherein the plurality of frequencies comprises a first frequency and a second frequency, wherein the first frequency is different from the second frequency, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the step of:

selecting a plurality of radiator components that serves to transmit first information over the first frequency and serves to transmit second information over the second frequency.

23. The method of claim 22, wherein the step of selecting the plurality of radiator components that serves to transmit the first information over the first frequency and serves to transmit the second information over the second frequency comprises the step of:

selecting the first information and the second information to comprise same information.

24. The method of claim 20, wherein the major dimension is greater than or equal to two meters and less than or equal to six meters.

25. The method of claim 20, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the step of:

selecting a plurality of radiator components that serves to transmit information over a plurality of frequencies in a range of two to thirty megahertz.

26. The method of claim 20, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the step of:

selecting a plurality of radiator components that serves to transmit information over any selected plurality of frequencies in a range of two to thirty megahertz.

27. The method of claim 20, wherein the range that comprises one or more octaves less than or equal to thirty megahertz comprises at least a first sub-range and a second sub-range that each comprise one or more octaves less than or equal to thirty megahertz, wherein the first sub-range is different from the second sub-range, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the step of:

selecting a plurality of radiator components that serves to transmit information over one or more frequencies in the first sub-range and serves to transmit information over one or more frequencies in the second sub-range.

28. The method of claim 27, wherein the range that comprises one or more octaves less than or equal to thirty megahertz comprises at least the first sub-range, the second sub-range, and a third sub-range, wherein each of the first sub-range, the second sub-range, and the third sub-range comprises one or more octaves less than or equal to thirty megahertz, wherein the first sub-range is different from the third sub-range, wherein the second sub-range is different from the third sub-range, wherein the step of selecting the plurality of radiator components that serves to transmit information over one or more frequencies in the first sub-range and serves to transmit information over one or more frequencies in the second sub-range comprises the step of:

selecting a plurality of radiator components that serves to transmit information over one or more frequencies in the first sub-range, serves to transmit information over one or more frequencies in the second sub-range, and serves to transmit information over one or more frequencies in the third sub-range.

29. The method of claim 20, wherein the range that comprises one or more octaves less than or equal to thirty megahertz comprises a plurality of sub-ranges that each comprise one or more octaves less than or equal to thirty megahertz, wherein at least two sub-ranges of the plurality of sub-ranges are different from each other, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the steps of:

selecting a plurality of sets of radiator components, wherein each set of the plurality of sets of radiator components serves to transmit information in a respective sub-range of the plurality of sub-ranges over a respective set of one or more frequencies; and selecting at least one set of the plurality of sets of radiator components to comprise at least two radiator components.

30. The method of claim 20, wherein the range that comprises one or more octaves less than or equal to thirty megahertz comprises at least a first sub-range and a second sub-range that each comprise one or more octaves less than or equal to thirty megahertz, wherein the first sub-range is different from the second sub-range, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the step of:

employing the first radiator component and the second radiator component to transmit information over one or more frequencies in the first sub-range;

further comprising the steps of:

selecting a third radiator component, and a fourth radiator component; and employing the third radiator component and the fourth radiator component to transmit information over one or more frequencies in the second sub-range.

31. The method of claim 20, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the step of:

embedding a plurality of radiator components in a structural component that serves to promote a decrease in radar cross section of a body.

32. The method of claim 20, wherein the step of selecting the first radiator component and the second radiator component that serve to transmit information over the plurality of frequencies in the range that comprises one or more octaves less than or equal to thirty megahertz, the step of selecting the first radiator component to comprise a major dimension that is less than or equal to nine meters, and the step of selecting the second radiator component to comprise a major dimension that is less than or equal to nine meters comprise the step of:

selecting a plurality of radiator components that allows transmission of information in substantially all directions relative to a particular location over the plurality of frequencies in the range that comprises one or more octaves less than or equal to thirty megahertz.

33. The method of claim 20, wherein the first radiator component and the second radiator component comprise a plurality of radiator components, and further comprising the steps of:

employing a network to couple the plurality of radiator components with a transmitter component, wherein the network comprises at least a first portion and a second portion, wherein the first portion is different from the second portion; and selecting the first portion to comprise a first impedance that comprises a preselected relationship with a second impedance of the second portion, wherein the preselected relationship serves to promote an approximate match between an overall impedance of the plurality of radiator components and an impedance of the transmitter component.

34. The method of claim 20, wherein the first radiator component and the second radiator component comprise a plurality of radiator components, and further comprising the steps of:

employing a network to couple the plurality of radiator components with a transmitter component, wherein the network comprises a plurality of portions that comprise respective impedances; and selecting the impedances to comprise a preselected interrelationship, wherein the preselected interrelationship serves to promote an approximate match between an overall impedance of the plurality of radiator components and an impedance of the transmitter component.

35. The method of claim 20, wherein the first radiator component and the second radiator component comprise a plurality of radiator components, and further comprising the steps of:

employing a network to couple the plurality of radiator components with a transmitter component, wherein the network comprises a first portion and a second portion, wherein the first portion is different from the second portion; and selecting the first portion to comprise a preselected relationship with the second portion, wherein the preselected relationship comprises a first sum of a first resistance of the first portion with a second resistance of the second portion to approximately a preselected first value, wherein the preselected relationship comprises a second sum of a first reactance of the first portion with a second reactance of the second portion to approximately a preselected second value, wherein the first sum and the second sum serve to promote an approximate match between an overall impedance of the plurality of radiator components and an impedance of the transmitter component.

36. The method of claim 20, wherein the first radiator component and the second radiator component comprise a plurality of radiator components, and further comprising the steps of:

employing a network to couple the plurality of radiator components with a transmitter component, wherein the network comprises a plurality of portions that comprise respective resistances and respective reactances;

selecting the resistances to comprise a preselected first interrelationship; and selecting the reactances to comprise a preselected second interrelationship, wherein the preselected first interrelationship and the preselected second interrelationship serve to promote an approximate match between an overall impedance of the plurality of radiator components and an impedance of the transmitter component.

37. The method of claim 20, wherein the first radiator component and the second radiator component comprise a plurality of radiator components, and further comprising the steps of:

selecting a network to couple the plurality of radiator components with a transmitter component; and employing the network to present to the transmitter component a voltage standing wave ratio of less than or equal to five to one.

38. The method of claim 20, wherein the first radiator component and the second radiator component comprise a plurality of radiator components, and further comprising the steps of:

selecting a network to couple the plurality of radiator components with a transmitter component; and employing the network to present to the transmitter component a voltage standing wave ratio of less than or equal to four to one.

* * * * *